US009540995B2

(12) United States Patent
Houtschilt et al.

(10) Patent No.: US 9,540,995 B2
(45) Date of Patent: Jan. 10, 2017

(54) EXHAUST VALVE ASSEMBLY

(71) Applicant: KATCON USA, Inc., Auburn Hills, MI (US)

(72) Inventors: Robert W. Houtschilt, Commerce Township, MI (US); John Boehnke, Grand Blanc, MI (US); Sandra Serna, Oakland Township, MI (US); Joseph Furnari, Washington, MI (US)

(73) Assignee: KATCON USA, Inc., Auburn Hills, MI (US)

( * ) Notice: Subject to any disclaimer, the term of this patent is extended or adjusted under 35 U.S.C. 154(b) by 779 days.

(21) Appl. No.: 13/787,006

(22) Filed: Mar. 6, 2013

(65) Prior Publication Data

US 2013/0233269 A1 Sep. 12, 2013

Related U.S. Application Data

(60) Provisional application No. 61/607,358, filed on Mar. 6, 2012, provisional application No. 61/735,775, filed on Dec. 11, 2012.

(51) Int. Cl.
*F02B 77/00* (2006.01)
*F01N 1/16* (2006.01)

(52) U.S. Cl.
CPC ..... *F02B 77/00* (2013.01); *F01N 1/163* (2013.01); *F01N 2240/36* (2013.01); *Y10T 29/49298* (2015.01)

(58) Field of Classification Search
CPC ..... F02B 77/00; F01N 1/163; F01N 2240/36; F01N 1/165; F01N 1/166; Y10T 29/49298
USPC ..... 123/336, 337, 403; 29/890.08; 181/237, 181/227, 228; 251/303
See application file for complete search history.

(56) References Cited

U.S. PATENT DOCUMENTS

| | | | |
|---|---|---|---|
| 735,912 | A | 8/1903 | Schrotz |
| 1,330,265 | A | 2/1920 | Hinton |
| 1,375,621 | A | 4/1921 | Wright, Jr. |
| 1,635,842 | A | 7/1927 | Hirshstein |
| 1,666,005 | A | 4/1928 | Culp |

(Continued)

FOREIGN PATENT DOCUMENTS

EP 0307898 A2 * 9/1988 ..... F02B 27/06

OTHER PUBLICATIONS

International Search Report for Application No. PCT/US2013/029392 dated May 9, 2013, 2 pages.

*Primary Examiner* — Hung Q Nguyen
(74) *Attorney, Agent, or Firm* — Howard & Howard Attorneys PLLC

(57) ABSTRACT

An exhaust valve assembly for use in an exhaust system includes a body region and an auxiliary region. The body region has first and second ends and defines a longitudinal axis defined between the ends. The body region has an interior surface terminating at the ends and defines a flow path along the axis and an opening. The auxiliary region is coupled to the body region about the opening. The auxiliary region has at least one wall that defines a space in communication with the opening outside the flow path. The exhaust valve assembly further includes a shaft coupled to the wall of the auxiliary region and a vane coupled to the shaft. The vane is movable between an open position with the vane disposed entirely within the auxiliary region and a closed position with at least a portion of the vane disposed in the body region intersecting the axis.

40 Claims, 16 Drawing Sheets

(56) References Cited

U.S. PATENT DOCUMENTS

| | | | | |
|---|---|---|---|---|
| 2,766,768 | A | 10/1956 | Brown et al. | |
| 2,895,562 | A | 7/1959 | Perry | |
| 2,970,803 | A | 2/1961 | Harza | |
| 3,234,924 | A | 2/1966 | May | |
| 3,300,137 | A | 1/1967 | Murphy | |
| 3,391,756 | A | 7/1968 | Larkfeldt et al. | |
| 3,482,603 | A | 12/1969 | Outcalt | |
| 3,559,679 | A | 2/1971 | Smirra | |
| 3,897,852 | A | 8/1975 | Hoffman et al. | |
| 3,921,657 | A | 11/1975 | Bergmark et al. | |
| 4,499,347 | A * | 2/1985 | Richards | H01H 35/40 200/81.9 M |
| 4,586,534 | A | 5/1986 | McNeely | |
| 4,699,244 | A | 10/1987 | Bergquist et al. | |
| 4,707,987 | A | 11/1987 | Atkin | |
| 4,903,486 | A | 2/1990 | Finkle | |
| 4,964,431 | A | 10/1990 | Ball et al. | |
| 5,046,408 | A | 9/1991 | Eugenio | |
| 5,238,220 | A | 8/1993 | Shell et al. | |
| 5,305,787 | A | 4/1994 | Thygesen | |
| 5,355,673 | A | 10/1994 | Sterling et al. | |
| 5,392,812 | A | 2/1995 | Herron | |
| 5,630,571 | A | 5/1997 | Kipp et al. | |
| 5,701,737 | A | 12/1997 | Branik et al. | |
| 5,709,241 | A | 1/1998 | Iwata | |
| 5,744,762 | A | 4/1998 | Seki et al. | |
| 5,801,343 | A | 9/1998 | Suzuki et al. | |
| 5,971,098 | A | 10/1999 | Suzuki et al. | |
| 5,984,045 | A | 11/1999 | Maeda et al. | |
| 6,050,294 | A | 4/2000 | Makowan | |
| 6,176,347 | B1 | 1/2001 | Chae et al. | |
| 6,189,650 | B1 | 2/2001 | Inuzuka et al. | |
| 6,193,214 | B1 | 2/2001 | Schatz | |
| 6,273,119 | B1 | 8/2001 | Foster et al. | |
| 6,425,412 | B2 | 7/2002 | Sterling | |
| 6,454,047 | B1 | 9/2002 | Galaitsis | |
| 6,467,441 | B2 | 10/2002 | Cristiani et al. | |
| 6,527,006 | B2 | 3/2003 | Jackson | |
| 6,604,516 | B1 | 8/2003 | Krimmer et al. | |
| 6,633,646 | B1 | 10/2003 | Hwang | |
| 6,637,449 | B2 | 10/2003 | Nagai et al. | |
| 6,659,422 | B2 | 12/2003 | Padroni | |
| 6,732,511 | B2 | 5/2004 | Unbehaun et al. | |
| 6,826,984 | B2 | 12/2004 | Poppen | |
| 7,040,451 | B2 | 5/2006 | Schumacher et al. | |
| 7,198,039 | B2 | 4/2007 | Takemoto et al. | |
| 7,374,147 | B2 | 5/2008 | Nohl et al. | |
| 7,401,592 | B2 | 7/2008 | Willats et al. | |
| 7,428,947 | B2 | 9/2008 | Nohl et al. | |
| 7,434,570 | B2 | 10/2008 | Hill | |
| 7,451,854 | B2 * | 11/2008 | Suzuki | F01N 1/165 181/237 |
| 7,503,544 | B2 | 3/2009 | Unbehaun et al. | |
| 7,536,990 | B2 | 5/2009 | Willats et al. | |
| 7,537,196 | B2 | 5/2009 | Nohl et al. | |
| 7,575,096 | B2 | 8/2009 | Arbuckle et al. | |
| 7,581,710 | B2 | 9/2009 | Abram et al. | |
| 7,584,938 | B2 | 9/2009 | Callahan et al. | |
| 7,628,250 | B2 | 12/2009 | Abram et al. | |
| 7,748,404 | B2 | 7/2010 | Abram et al. | |
| 7,775,322 | B2 | 8/2010 | Hill | |
| 7,805,933 | B2 | 10/2010 | Hanitzsch et al. | |
| 7,896,130 | B2 | 3/2011 | Hill et al. | |
| 8,201,401 | B2 | 6/2012 | Abram et al. | |
| 2005/0189166 | A1 | 9/2005 | Kikuchi et al. | |
| 2005/0205722 | A1 | 9/2005 | Krueger | |
| 2006/0027420 | A1 | 2/2006 | Hahnl et al. | |
| 2007/0080314 | A1 | 4/2007 | Abram et al. | |
| 2008/0083218 | A1 | 4/2008 | Abram et al. | |
| 2008/0224083 | A1 | 9/2008 | Hill | |
| 2008/0236680 | A1 | 10/2008 | Abram et al. | |
| 2008/0245063 | A1 | 10/2008 | Hill | |
| 2009/0084998 | A1 | 4/2009 | Callahan et al. | |
| 2009/0126356 | A1 | 5/2009 | Abram et al. | |
| 2009/0126357 | A1 | 5/2009 | Abram | |
| 2009/0126359 | A1 | 5/2009 | Abram et al. | |
| 2009/0127022 | A1 | 5/2009 | Abram et al. | |
| 2009/0319160 | A1 | 12/2009 | Callahan et al. | |
| 2010/0043398 | A1 | 2/2010 | Abram et al. | |
| 2010/0126625 | A1 | 5/2010 | Berghorst | |
| 2010/0192560 | A1 | 8/2010 | Abram et al. | |
| 2010/0229543 | A1 | 9/2010 | Venghaus et al. | |
| 2010/0263743 | A1 | 10/2010 | Lefler et al. | |
| 2011/0011669 | A1 | 1/2011 | Zelinski | |
| 2011/0297862 | A1 | 12/2011 | Womann et al. | |

* cited by examiner

EXHAUST VALVE ASSEMBLY

CROSS REFERENCE TO RELATED APPLICATIONS

This application claims priority to and all the benefits of U.S. Provisional Patent Application Ser. No. 61/607,358 filed on Mar. 6, 2012, and U.S. Provisional Patent Application Ser. No. 61/735,775 filed on Dec. 11, 2012, the entire specifications of which are expressly incorporated herein by reference.

BACKGROUND

1. Field of the Present Disclosure

The present disclosure relates generally to an exhaust valve assembly, and more specifically, to an exhaust valve assembly for a vehicle exhaust system.

2. Description of the Related Art

Mostly every vehicle includes a combustion engine having an exhaust system. The exhaust system typically includes exhaust pipes for directing a flow of exhaust gas from an engine to various exhaust system components, such as a muffler and a resonator.

Some exhaust systems do not perform optimally. For instance, the flow of exhaust gas passing through the exhaust system may generate undesirable acoustic noise, such as low-frequency noise. In these situations, the exhaust system may require specific tuning to attenuate the undesirable acoustic noise.

An exhaust valve can be incorporated into the exhaust system to attenuate the undesirable acoustic noise. In an example, the exhaust valve is designed to control the flow of exhaust gas passing through the exhaust system by a spring, which is configured to bias a valve plate or vane against the flow of the exhaust gas. In doing so, the exhaust valve provides variable backpressure against the flow of exhaust gas, thereby attenuating the acoustic noise.

It has been found, however, that some exhaust valves have several disadvantages. For instance, the exhaust valve may be difficult to manufacture and maintain. In particular, the spring, the vane, and perhaps one or more other exhaust valve components may be permanently installed within the architecture of the exhaust valve. For at least this reason, in some instances, it may thus be difficult to access the exhaust system components for purposes of maintenance, to replace a component, and/or the like. In addition, the exhaust valve may be limited in application, and may be non-adjustable in various clearance situations. This is due, at least in part, to the exhaust valve being permanently integrated as part of the exhaust system.

SUMMARY

An exhaust valve assembly for an exhaust system is disclosed. The exhaust valve assembly comprises a body region having a first end and a second end. The body region defines a longitudinal axis between the ends with the body region having an interior surface terminating at the ends. A flow path is defined along the axis. The body region also defines an opening. The exhaust valve assembly further comprises an auxiliary region coupled to the body region about the opening. The auxiliary region has at least one wall defining a space in communication with the opening outside of the flow path. A shaft is coupled to the wall of the auxiliary region, and a vane is coupled to the shaft. The vane is moveable between an open position with the vane disposed entirely within the auxiliary region and a closed position with at least a portion of the vane disposed in the body region intersecting the axis.

BRIEF DESCRIPTION OF THE DRAWINGS

Advantages of the present disclosure will be readily appreciated, as the same becomes better understood by reference to the following detailed description, when considered in connection with the accompanying drawings.

DETAILED DESCRIPTION

Figure 1:
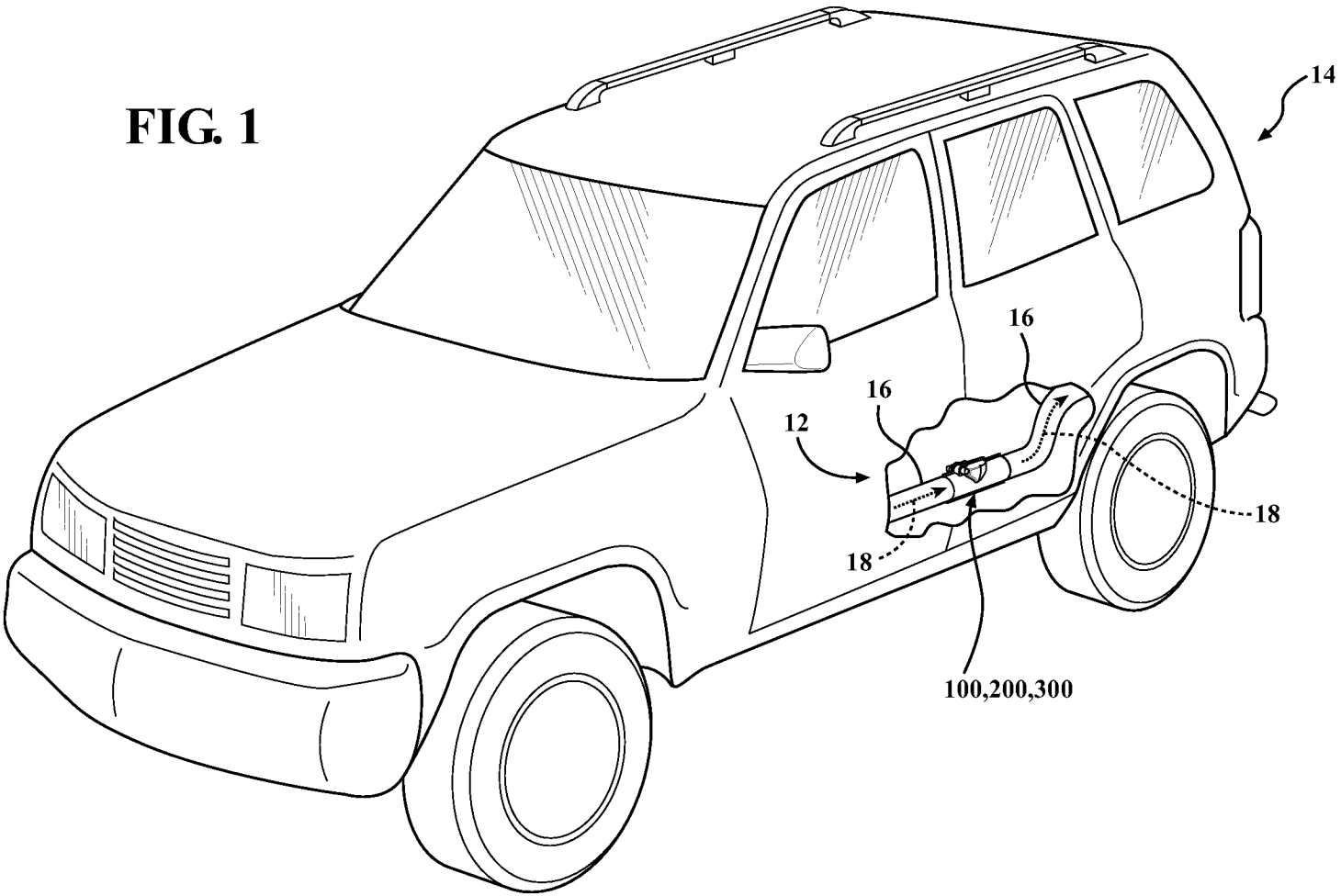
FIG. 1 is a perspective view of a vehicle including an exhaust system with an example of an exhaust valve assembly operatively coupled to the exhaust system.

Referring now to the figures, wherein like numerals indicate corresponding parts throughout the several views, examples of an exhaust valve assembly 100, 200, 300, 400, 500, 700, 800, 900, 1000, 1100 are shown throughout the figures and are described in detail below. The examples of the exhaust valve assembly 100, 200, 300, 400, 500, 700, 800, 900, 1000, 1100 are designed to be operatively coupled to an exhaust system 12 of a vehicle 14. For example, and as shown in FIG. 1, the exhaust valve assembly 100, 200, 300 is coupled between two exhaust pipes 16 of the exhaust system 12. In other examples that are not shown in the figures, the exhaust valve assembly 100, 200, 300, 400, 500, 700, 800, 900, 1000, 1100 may be disposed at an inlet or an outlet of an exhaust pipe or the exhaust valve assembly 100, 200, 300, 400, 500, 700, 800, 900, 1000, 1100 may be disposed within components of the exhaust system 12, such as within a muffler. Additionally, the exhaust valve assembly 100, 200, 300, 400, 500, 700, 800, 900, 1000, 1100 may be utilized in various exhaust systems, such as exhaust systems of spark-ignition engines, exhaust systems of compression-ignition engines, exhaust systems of naturally aspirated engines, and/or exhaust systems of pressurized engines.

Details of the examples of the exhaust valve assembly 100, 200, 300, 400, 500, 700, 800, 900, 1000, 1100 are set forth below. In each of these examples, the exhaust valve assembly 100, 200, 300, 400, 500, 700, 800, 900, 1000, 1100 is designed to effectively attenuate undesirable acoustic noise generated by a flow 18 of exhaust gas (depicted as arrows in FIG. 1) passing through the pipes 16 of the exhaust system 12.

Additionally, the exhaust valve assembly 100, 200, 300, 400, 500, 700, 800, 900, 1000, 1100 is easy to manufacture and maintain, as none of the components of the exhaust valve assembly 100, 200, 300, 400, 500, 700, 800, 900, 1000, 1100 are necessarily permanent and all of the components of the exhaust valve assembly 100, 200, 300, 400, 500, 700, 800, 900, 1000, 1100 are easily accessible.

Some examples of the exhaust valve assembly 100, 200, 300, 400, 500 of the present disclosure have a housing having a body region that is integrally formed to an auxiliary region. These examples are described below with reference to FIGS. 1 through 15. Other examples of the exhaust valve assembly 700, 800, 900, 1000, 1100 of the present disclosure have a body region and an auxiliary region that are connected to one another. These examples are described below with reference to FIGS. 19 through 26.

One example of the exhaust valve assembly 100 will now be described in conjunction with FIGS. 2 through 7. In this example, the exhaust valve assembly 100 includes a first piece 102 and a second piece 112. The first piece 102 has a first body region 104 having a first body edge 108 and a first auxiliary region 106 having a first auxiliary edge 110. The first auxiliary region 106 is coupled to the first body region 104. For instance, and as better shown in FIGS. 2 and 3, the first auxiliary region 106 is integrally formed with the first body region 104.

The second piece 112 of the exhaust valve assembly 100 has a second body region 114 having a second body edge 118 and a second auxiliary region 116 having a second auxiliary edge 120. The second auxiliary region 116 is coupled to the second body region 114. For instance, the second auxiliary region 116 is integrally formed with the second body region 114.

Figure 2:
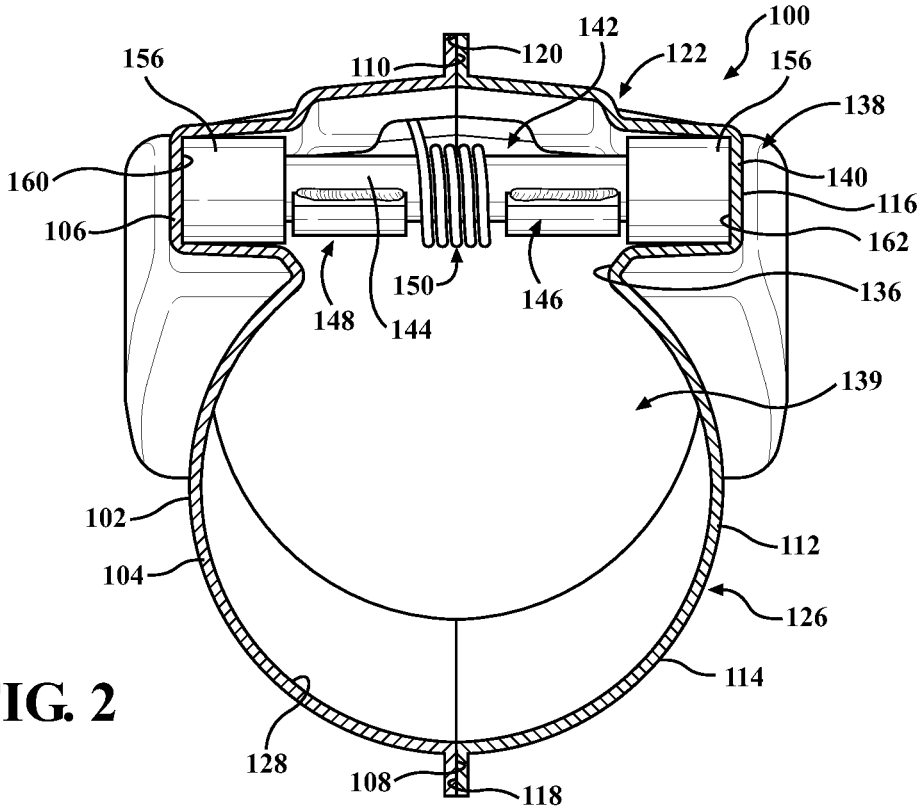
FIG. 2 is a perspective, end view of a portion of an example of the exhaust valve assembly including first and second pieces that are joined together along respective complementary edges to form a housing having a body region and an auxiliary region and a vane assembly operative disposed in the housing.
Figure 5:
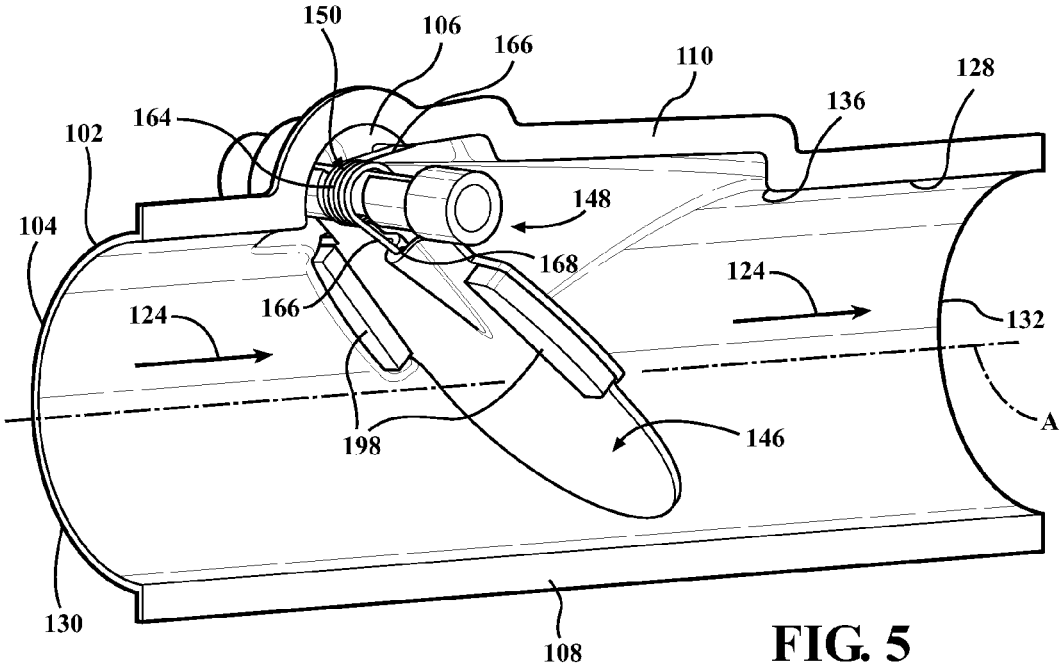
FIG. 5 is a perspective view of the first piece of the exhaust valve assembly of FIG. 2 with the vane assembly operatively coupled to the first piece with the vane in a closed position.
Figure 6:
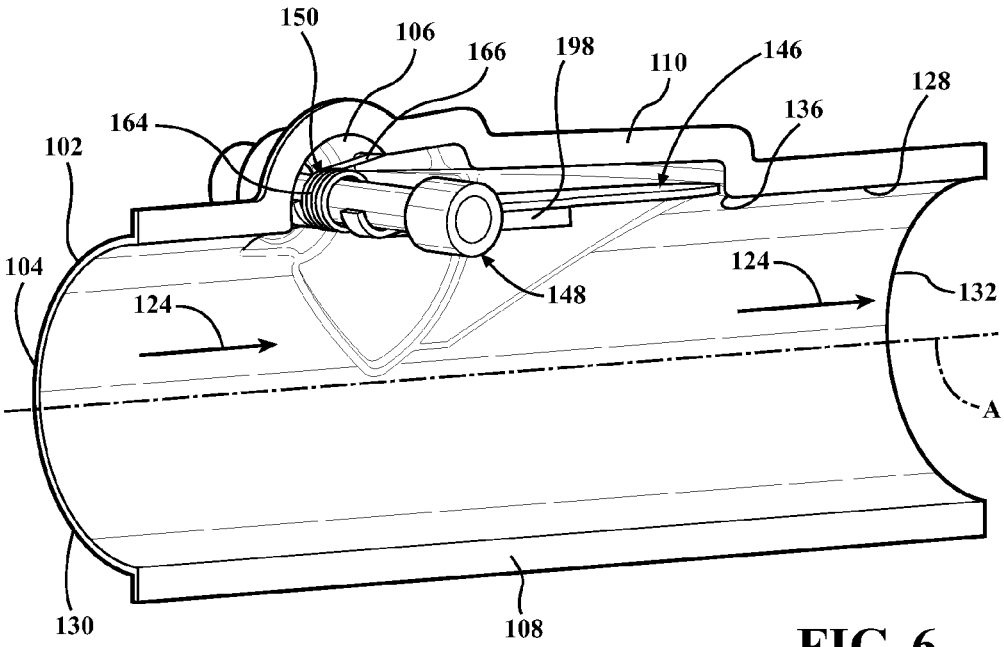
FIG. 6 is a perspective view of the first piece of the exhaust valve assembly of FIG. 2 with the vane assembly operatively coupled to the first piece with the vane in an open position.

As depicted in FIG. 2, the first 102 and second 112 pieces are joined to one another along the first 108 and second 118 body edges and along the first 110 and second 120 auxiliary edges to form a housing 122. In other words, the first 102 and second 112 pieces may be joined to one another by joining the first body edge 108 to the second body edge 118 and joining the first auxiliary edge 110 to the second auxiliary edge 120. Joining may be accomplished mechanically (e.g., a clamp, a fastener, or the like), metallurgically (e.g., a weld), or combinations thereof. As a housing 122, the first 104 and second 114 body regions together define a longitudinal axis A (as shown in FIGS. 5 and 6) and a flow path 124 (depicted as arrows in FIGS. 5 an 6) extending along the longitudinal axis A. The flow path 124 is a bounded area for which the flow of an exhaust gas generated by the vehicle 14 follows.

In an example, the first 102 and second 112 pieces are mirror images of each other. It is to be understood, however, that the first 102 and second 112 pieces may have different respective configurations. For instance, the first piece 102 may have a first body region 104 that has a rounded shape, while the second piece may have a second body region 114 that has a half square shape. However, in these instances, it is desirable to have complementary first 108 and second 118 body edges and complementary first 110 and second 120 auxiliary edges so that the two pieces 102, 112 can be suitably joined together.

It is further to be understood that when the first 104 and second 114 body regions are joined together (upon joining the first 102 and second 112 pieces to one another), a single body region 126 is formed. As shown in FIG. 2, the body region 126 has a generally hollow configuration, and has a surface 128 that terminates at opposing first 130 and second 132 ends (shown in FIGS. 5 and 6). The first 130 and second 132 ends are spaced apart from one another along a length of the body region 126, and are each configured to be coupled to a component, such as an exhaust pipe 16, of the exhaust system 12. In one example, the first end 130 is coupled to one exhaust pipe 16 and receives the flow 18 of exhaust gas generated by the vehicle 14, and the second end 132 is coupled to another exhaust pipe 16 and allows the flow 18 of exhaust gas to exit the exhaust valve assembly 100. In the example depicted in FIGS. 2 through 7, the body region 126 has a circular/substantially circular cross-section. It is to be appreciated, however, that the body region 126 may have other cross-sections, such as a rectangular cross-section, a hexagonal cross-section, or the like.

As previously mentioned, the body region 126 includes the flow path 124 for the flow 18 of exhaust gas generated by the vehicle 14. The flow path 124 extends from the first end 130 to the second end 132 of the body region 126 along the longitudinal axis A.

The body region 126 further includes an opening 136 defined in the surface 128 between the first 130 and second 132 ends. This is best shown in FIGS. 5 and 6. The opening 136 may have any suitable configuration, such as circular, square, rectangular, etc.

When the first 106 and second 116 auxiliary regions are joined together (again, upon joining the first 102 and second 112 pieces to one another), a single auxiliary region 138 is formed. The auxiliary region 138 is coupled to the body region 126. Again, the first auxiliary region 106 is integrally formed with the first body region 104 and the second auxiliary region 116 is integrally formed with the second body region 114. Then, the first auxiliary region 106 is joined to the second auxiliary region 116 when the pieces 102, 112 are joined to one another.

The auxiliary region 138 includes at least one wall 140 that defines a space 142 inside the auxiliary region 138. The auxiliary region 138 is formed around the opening 136 such that the auxiliary region 138 encapsulates the opening 136 and enables communication, such as fluid communication, between the space 142 and an area defined by the surface 128 of the body region 126. Although the space 142 is in communication with the area of the body region 126, the space 142 is outside the flow path 124 and thus the flow 18 of exhaust gas passing through the exhaust system 12, when the exhaust valve assembly 100 is in an open position, is substantially unaltered by the auxiliary region 138. The open position of the exhaust valve assembly 100 will be described in further detail below.

The auxiliary region 138 is generally designed to house various auxiliary components of the exhaust valve assembly 100, such as a shaft 144, a vane 146, and a resilient member 150, which in some examples collectively constitute a vane assembly 148. Examples of the vane assembly 148 will now be described in conjunction with FIG. 4. In one example, the vane assembly 148 includes the shaft 144 and the vane 146, but does not include a resilient member 150. This example of the vane assembly 148 is usable for active exhaust systems, in which a control system, such as an actuator (not shown), dictates the movement of the vane 146 between open and closed positions inside the exhaust valve assembly 100. In another example, the vane assembly 148 includes the shaft 144, the vane 146, and the resilient member 150. This example of the vane assembly 148 may be used for passive exhaust systems, in which the resilient member 150 biases the vane 146 to a closed position and relies on the pressure from the flow 18 of exhaust gas passing through the exhaust system 12 to move the vane 146 into an open position. The latter example may also be used for exhaust systems that are both active and passive. In this example, the exhaust system may be passive until the passive operation is overridden by a control device.

Figure 4:
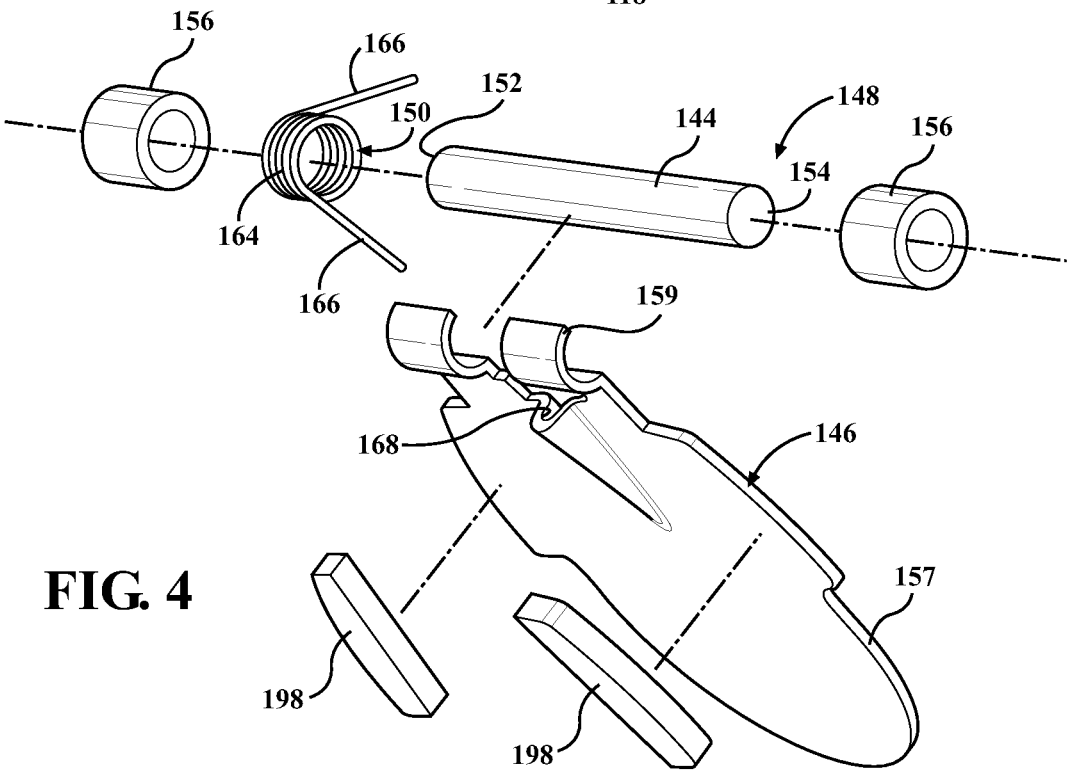
FIG. 4 is an exploded view of the vane assembly for the exhaust valve assembly of FIG. 2.
Figure 3:
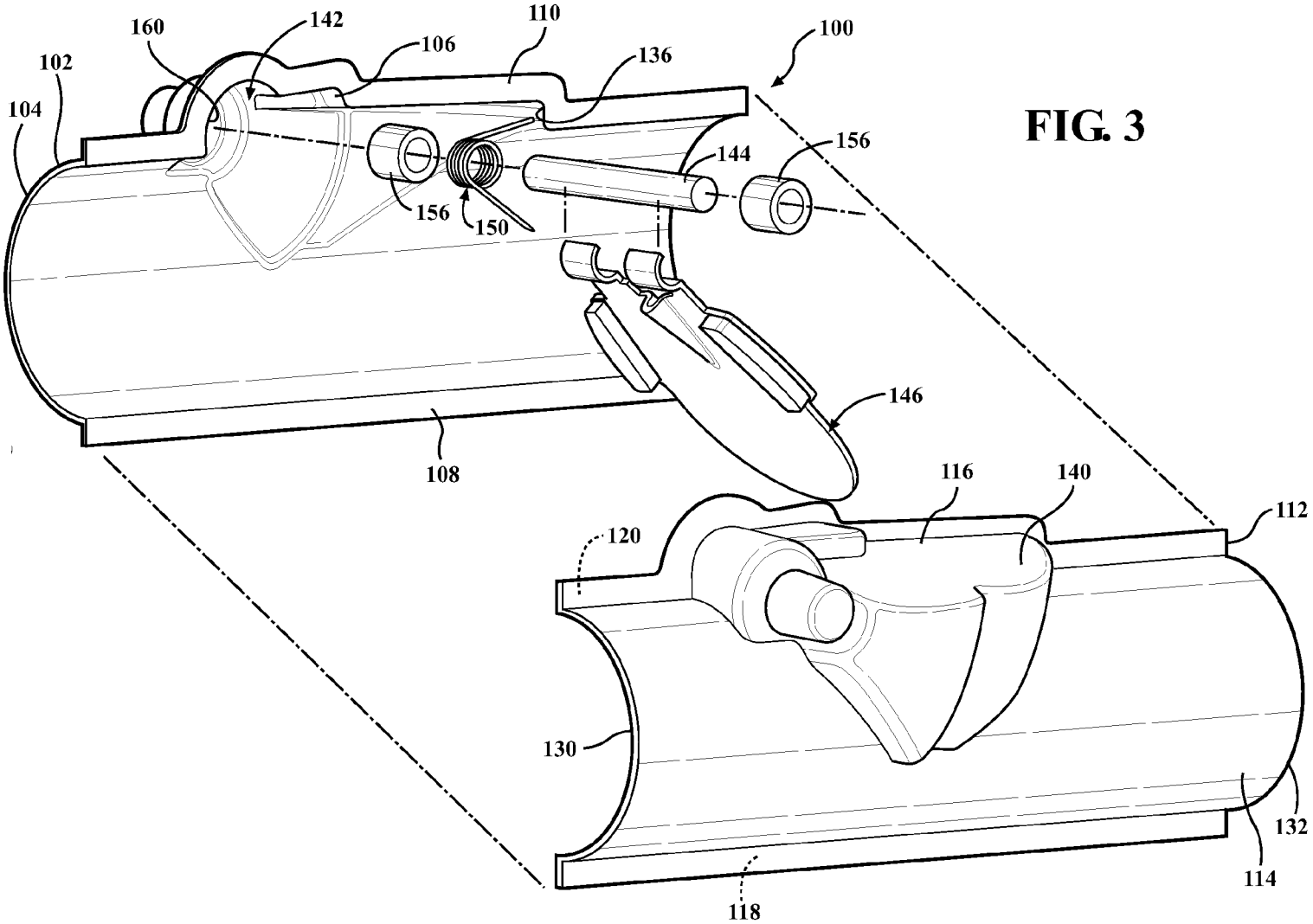
FIG. 3 is an exploded view of a perspective view of the exhaust valve assembly of FIG. 2.

The shaft 144 has opposing ends 152, 154, each coupled to the wall 140 of the auxiliary region 138. In an example, and as shown in FIGS. 2 through 4, a bushing 156 is disposed about each end 152, 154, and the ends 152, 154 having the bushing 156 disposed thereabout are received in respective recesses 160, 162 of the wall 140. The bushing 156 is designed to couple the shaft 144 to the wall 140 and to permit relative rotation of the shaft 144 to the wall 140. In another example, the ends 152, 154 are fixedly mounted within the recesses 160, 162 of the wall 140 with or without a bushing 156. In this example, the shaft 144 does not rotate relative to the wall 140.

The vane 146 is coupled to the shaft 144, and has a geometry and surface area that enables the vane 146 to interact with the flow 18 of exhaust gas. In an example, and as shown at least in FIG. 4, the vane 146 has a planar configuration. It is to be understood, however, that the vane 146 may have any suitable non-planar configuration so long as the vane 146 sufficiently interacts with the flow 18 when the vane 146 is moved toward the closed position. Examples of non-planar configurations include sail-type configurations and wing-type configurations. Further, the vane 146 has an outer edge 157 that, in some examples, may conform/substantially conform to the cross-section of the body region 126. It is believed that this configuration will optimize alteration of the flow 18 of exhaust gas. It is to be understood, however, that particular segments of the outer edge 157 of vane 146 may not conform to the cross-section of the body region 126.

The vane 146 may be coupled to the shaft 144 at any desirable location on the vane 146. In one example, the vane 146 is coupled to the shaft 146 near one extremity 159 of the vane 146 such that the surface area of the vane 146 is undivided/substantially undivided by the shaft 144. This example is shown in FIGS. 2, 5 and 6.

Figure 7:
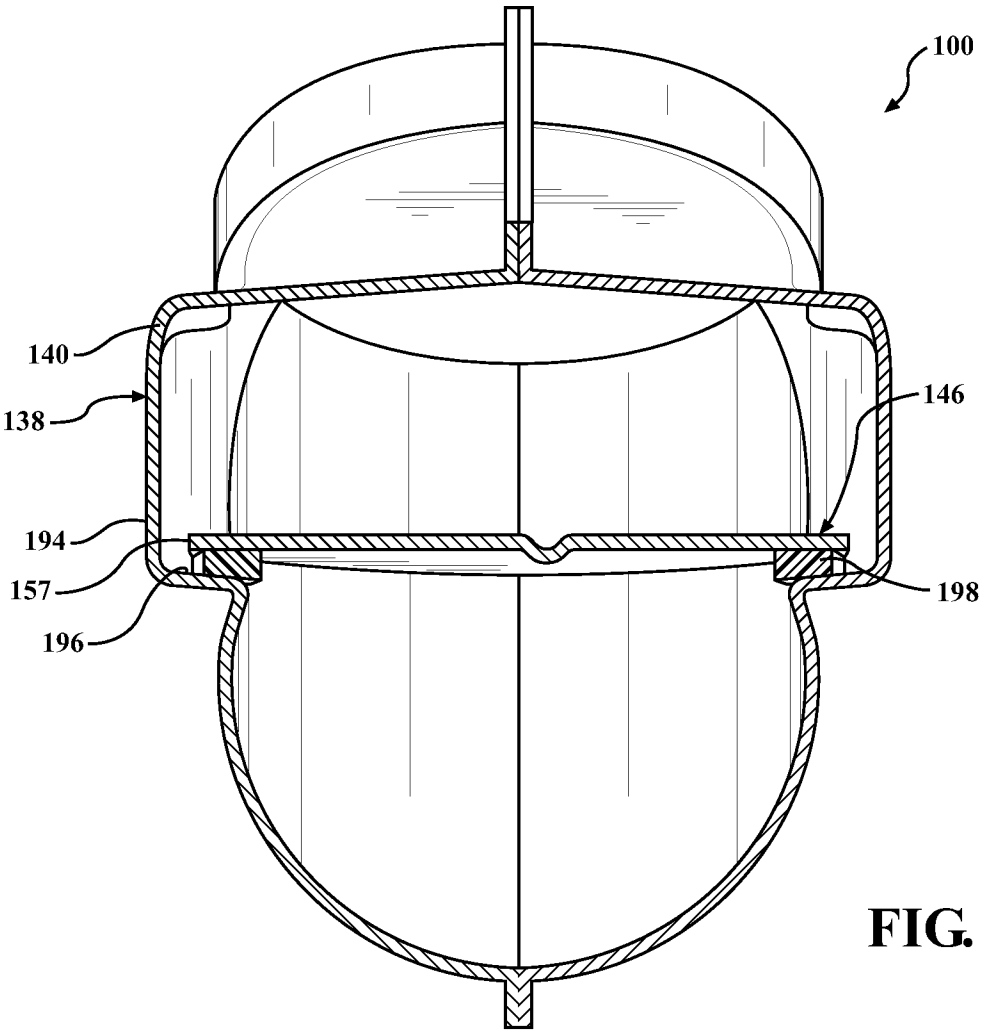
FIG. 7 is a perspective, angled view of another example of the exhaust valve assembly, where a portion of the auxiliary region radially protrudes from a longitudinal axis defined by first and second ends of the body region to form ledges and the vane assembly includes pads coupled to the vane where each pad is configured to contact a respective ledge when the vane is in the closed position.

The vane assembly 148 may, in some examples, include one or more pads 198 coupled to the vane 146. The pad(s) 198 are configured to contact a ledge formed in the wall 140 of the auxiliary region 138. As shown in FIG. 7, a portion 194 of the wall 140 of the auxiliary region 138 radially protrudes from the longitudinal axis (not identified in FIG. 7) to form a ledge 196. The vane assembly 148 includes the pad(s) 198 coupled to the vane 146. The pad(s) 198, which may be a mesh pad, a foam pad, or the like, is configured to contact the ledge 196 when the vane 146 is in the closed position. It is believed that the pad(s) 198 will attenuate noise generated by the vane 146 as the vane 146 contacts the ledge 196.

In the example depicted in FIG. 7, two pads 198 are coupled to the vane 146. It is to be understood, however, that the vane 146 may include any number of pads 198 depending on the number of ledges 196 that are formed in the auxiliary region 138, or may include one continuous pad that surrounds at least a portion of the periphery of the vane 146. Additionally, in this example, the outer edge 157 of the vane 146 has a shape or geometry that is complementary in configuration to a shape of the portion 194 of the auxiliary region 138.

Figure 22:
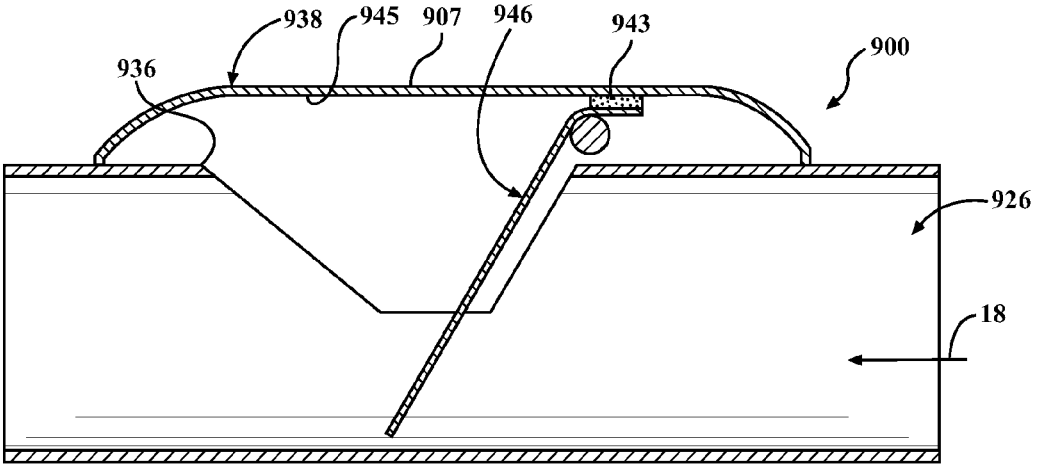
FIG. 22 is a side view of an example of the exhaust valve assembly of FIG. 21 depicting the vane of the vane assembly in the closed position.
Figure 23:
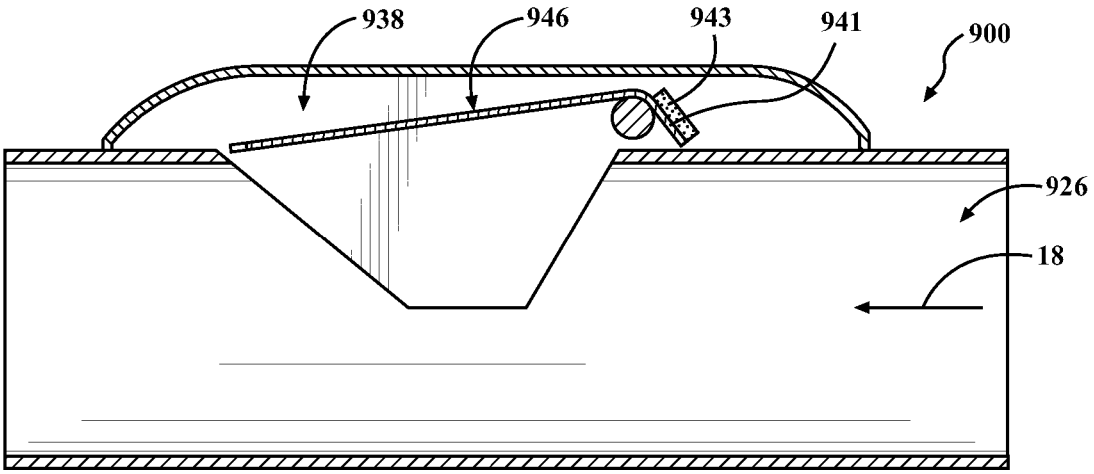
FIG. 23 is a side view of the example of the exhaust valve assembly of FIG. 21 depicting the vane of the vane assembly in the open position.
Figure 24:
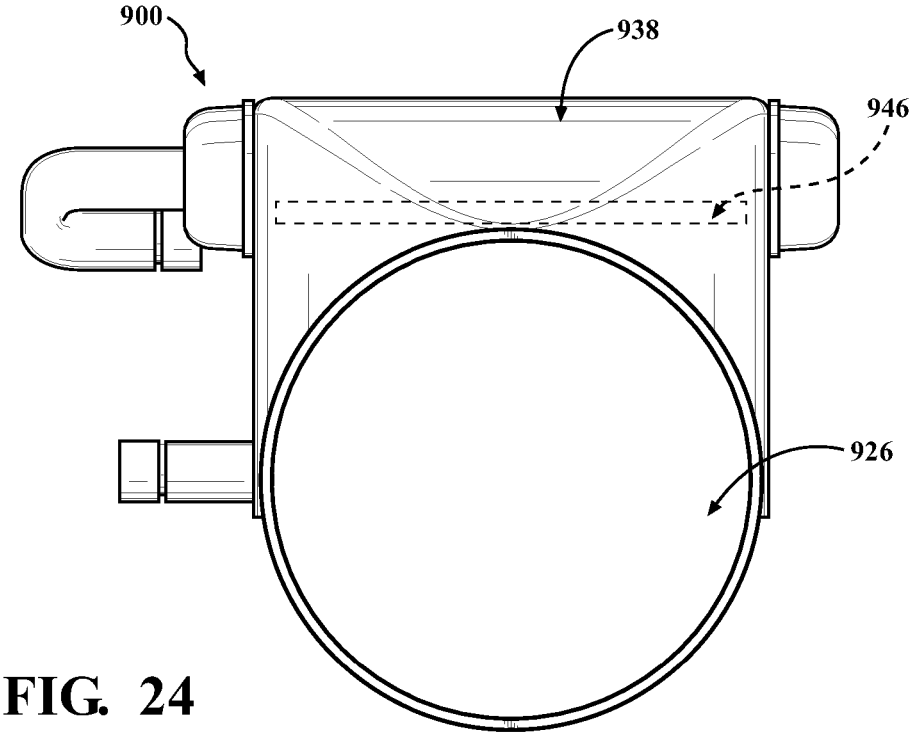
FIG. 24 is a front view of the exhaust valve assembly of FIG. 21 depicting the vane in the open position and disposed completely outside of the flow path of the body region.
Figure 25:
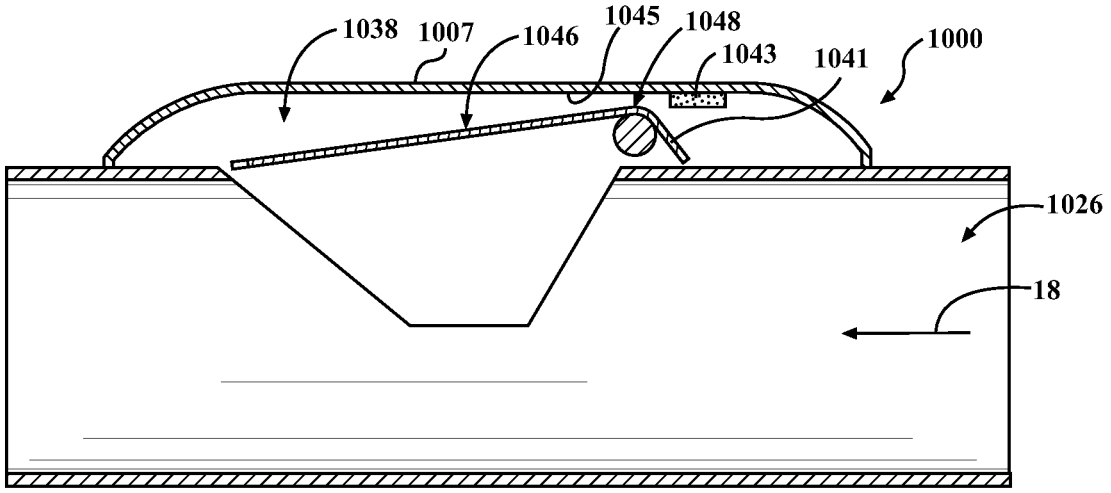
FIG. 25 is a side view of still another example of the exhaust valve assembly depicting the vane of the vane assembly in the closed position, where the exhaust valve assembly further includes a stop pad disposed on the wall of the auxiliary region.

In the example in which the shaft 144 is coupled to the wall 140 so the shaft can rotate relative to the wall 140, the vane 146 is fixedly mounted to the shaft 144. In the example in which the shaft 144 is fixedly mounted to the wall 140, the vane 146 is coupled to the shaft 144 so that the vane 146 can rotate relative to the shaft 144. For any of the examples described immediately above, the vane 146 is configured to move between a closed position (as shown in FIG. 5) and an open position (as shown in FIG. 6). As used herein, the term "closed position" refers to a fully closed position (where the vane 146 substantially blocks the flow 18 of exhaust gas passing through the exhaust system 12) or a partially closed position (where the vane 146 partially blocks the flow 18 of exhaust gas passing through the exhaust system 12). The closed position is also shown in FIG. 22, which is described in detail below. For purposes of the instant disclosure, the vane 146 is considered to be in the closed position whenever at least a portion of the vane 146 intersects the flow path 124 and obstructs the flow 18 of exhaust gas inside the body region 126. Furthermore, the term "open position" refers to a fully open position, where virtually no portion of the vane 146 intersects the flow path 124 inside the body region 126. When the vane 146 is in the open position, the vane 146 is completely housed inside the auxiliary region 138, and the flow 18 of the exhaust gas remains unobstructed by the vane 146. This is also shown in FIGS. 23 through 25, which are described in further detail below. The whole vane 146 exits the body region 126 through the opening 136 when the vane 146 moves from the closed position into the open position.

In one example, the vane 146 is at least partially disposed within the body region 126 and at least partially disposed within the auxiliary region 138 when the vane 146 is in a resting position. For passive systems, the resting position is determined when the vane 146 is biased to the closed position by virtue of the resilient member 150. For active systems, the resting position is determined by the control device. In this example, the vane 146 rests about the shaft 144 at a predetermined angle (as shown, for example, in FIG. 5).

In one specific example of the present disclosure, the vane 146 is fixedly mounted to the shaft 144 and rotates concurrently with the rotation of the shaft 144 in response to forces exerted on the vane 146. The vane 146 is biased to the closed position, by virtue of the resilient member 150, in response to forces exerted on the vane 146 generated by the flow 18 of exhaust gas. The forces exerted on the vane 146 causes the vane 146 to rotate as the vane 146 moves toward the open position.

In examples where the vane assembly 148 includes a resilient member 150, the resilient member 150 may be a spring that is disposed about the shaft 144 between the ends 152, 154. As previously mentioned, the resilient member 150 biases the vane 146 against the flow 18 of exhaust gas (i.e., toward the closed position). The resilient member 150 may bias the vane 146 in a clockwise direction or in a counter clockwise direction depending, at least in part, on the configuration of the exhaust valve assembly 100. It is to be understood that the resilient member 150 generally counter-balances the vane 146 against the flow 124 to reduce resonance frequencies, to reduce the volume of tuning elements, and to increase acoustic damping of the exhaust system 12. The resilient member 150 in combination with the vane 146 also provides variable backpressure against the flow 18 of exhaust gas in order to attenuate acoustic noise generated by the flow 18.

In the examples depicted in FIGS. 2 through 7, the resilient member 150 is a torsion spring having a single coil 164 with two legs 166. The coil 164 generally has more than one winding. Although the example depicted in FIGS. 2 through 7 shows that the coil 164, the coil may otherwise have fewer than five windings (e.g., three windings) or more than five windings. The coil 164 is disposed on the shaft 144, between the ends 152, 154, and as shown in FIGS. 5 and 6, one leg 166 rests against the vane 146 inside a pocket 168 formed into one side of the vane 146 and the other leg 166 contacts the wall 140 of the auxiliary region 138. It is to be understood that the resilient member 150 may have other spring configurations, such coiled springs, torsional springs with configurations that are different than the one described immediately above, and/or spiral springs. The spring may also be extension biased, compression biased, or torsionally biased.

Figure 8:
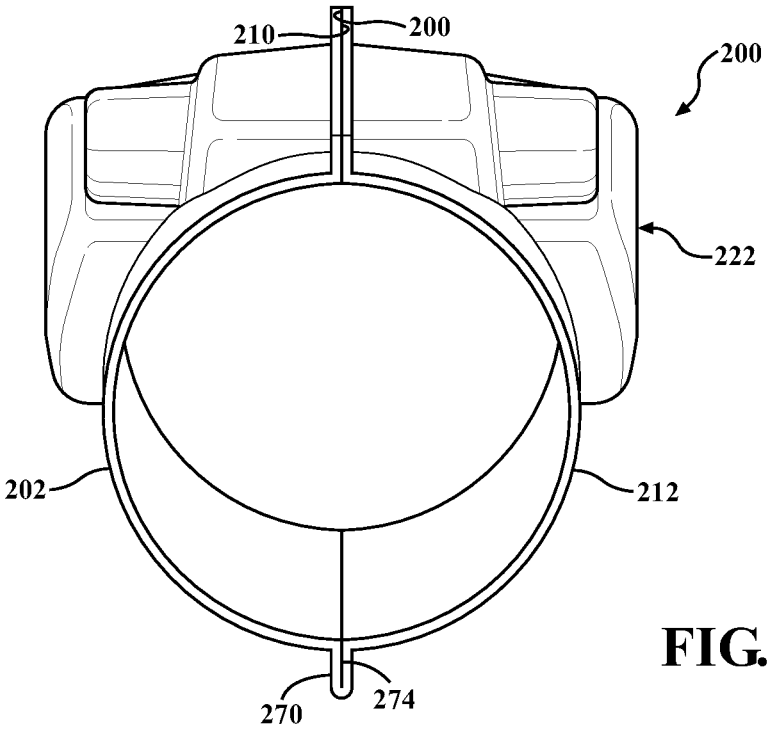
FIG. 8 is a perspective, end view of another example of an exhaust valve assembly, where the first and second pieces are partially pre-joined joined to one another through a living hinge, and the first and second pieces are joined to one another along respective complementary edges.
Figure 9:
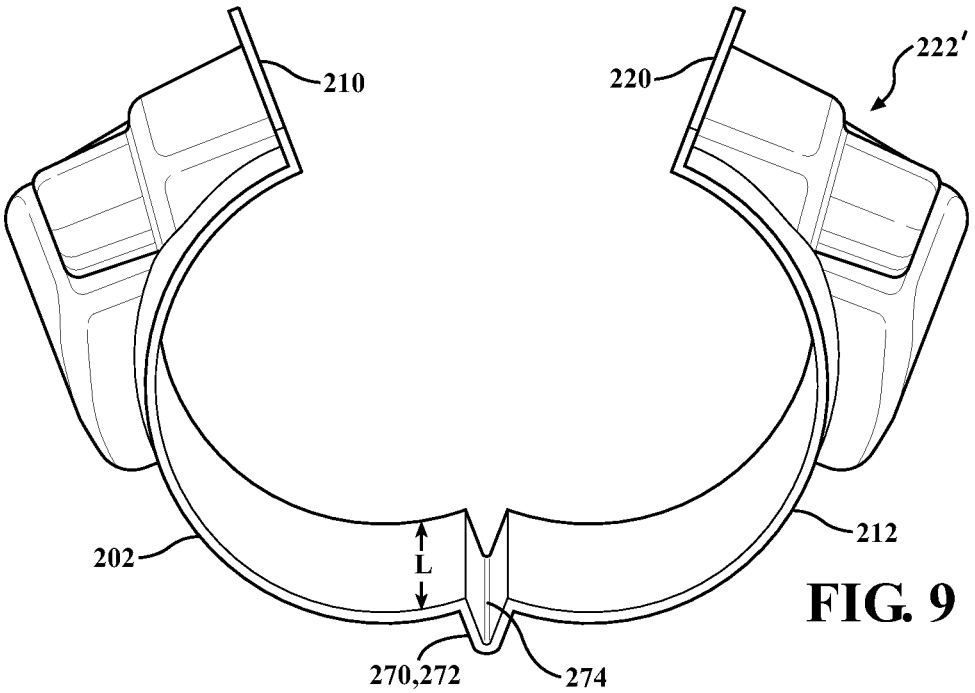
FIG. 9 is a perspective, end view of the first and second pieces depicted in FIG. 8, where the first and second pieces are partially pre-joined to one another through the living hinge but the first and second pieces are not yet joined to one another along respective complementary edges.

Another example of the exhaust valve assembly 200 will now be described in conjunction with FIGS. 8 and 9. The exhaust valve assembly 200 is essentially the same as the exhaust valve assembly 100 as previously described; however, the exhaust valve assembly 200 has a housing 222 formed from two pieces 202, 212 that are partially pre-joined to one another through a living hinge 270, similar to a clamshell configuration. The living hinge 270 is a thin flexible hinge made from the same material as the two pieces 202, 212. In an example, the first 202 and second 212 pieces are initially formed as a single part (i.e., a pre-housing 222' as shown in FIG. 9) with a thinned or cut portion 272 along a length L of the part at a dividing line 274 between the two pieces 202, 212. The thinned or cut portion 272 allows the two pieces 202, 212 to bend along the dividing line 272 (i.e., bending the living hinge 270) when the housing 222 is formed. Upon bending the living hinge 270, the first 210 and second 220 auxiliary edges are mechanically and/or metallurgically coupled to one another as shown in FIG. 8.

Figure 10:
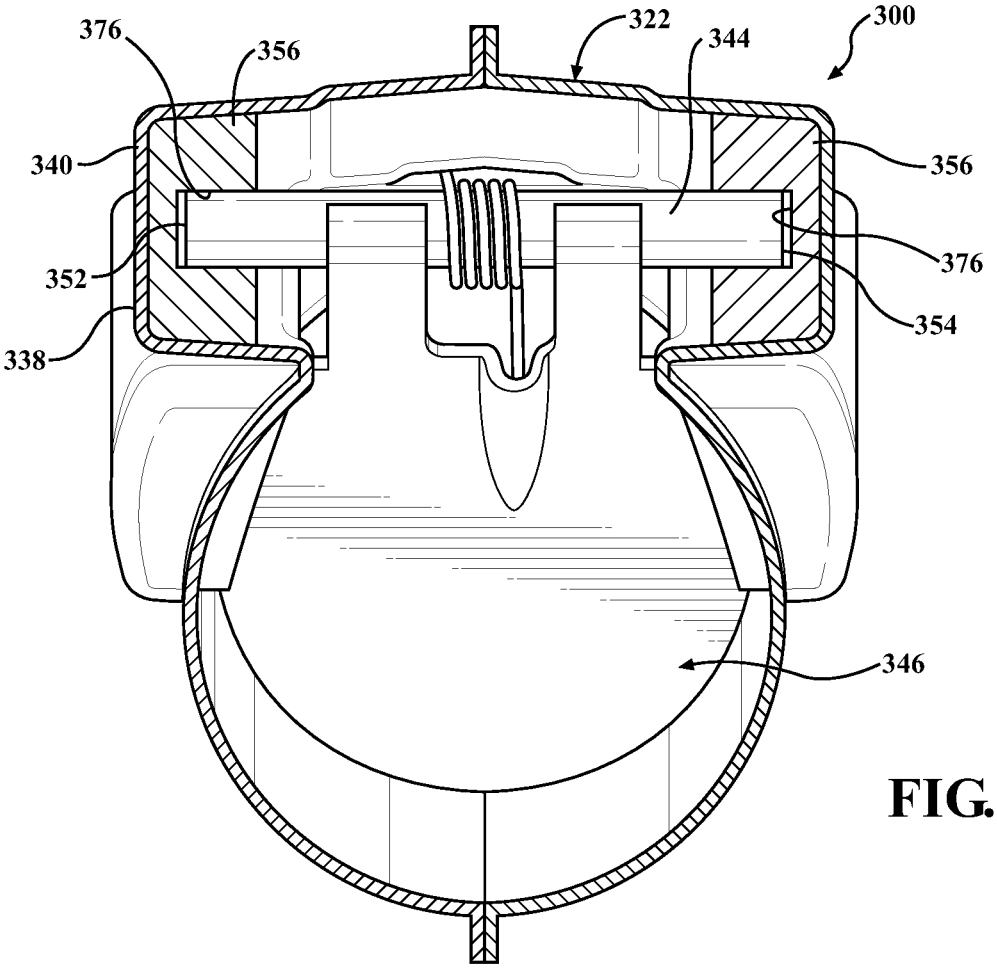
FIG. 10 is a perspective, end view of a portion of another example of the exhaust valve assembly including a bushing disposed about each end of the shaft of the vane assembly.
Figure 11:
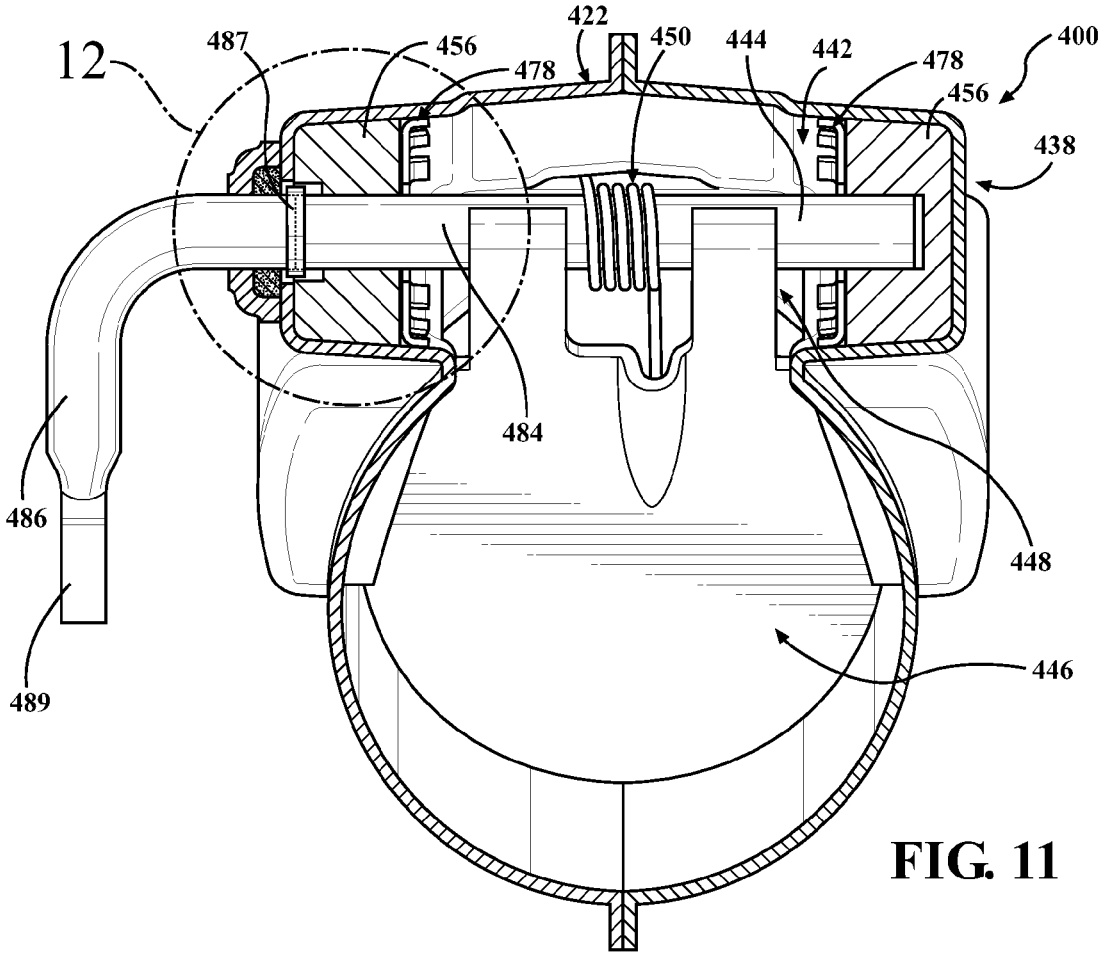
FIG. 11 is a perspective, end view of a portion of still another example of the exhaust valve assembly, where the shaft of the vane assembly includes a first portion disposed in the auxiliary region and a second portion disposed outside of a space defined in the auxiliary region, and the exhaust valve assembly further includes a cap disposed around the second portion of the shaft, where the cap includes a cavity having a mesh pad disposed therein.

Another example of the exhaust valve assembly 300 is shown in FIG. 10. In this example, the exhaust valve assembly 300 includes all of the features of the exhaust valve assembly 100. However, in the exhaust valve assembly 300, each of the bushings 356 has a pocket 376 defined therein with each of the ends 352, 354 of the shaft 344 disposed in one of the pockets 376. In another example, at least one of the bushings 356 has a pocket 376 defined therein with at least one of the ends 352, 354 of the shaft 344 disposed in the pocket 376. For instance, one of the bushings 356 may have a pocket 376 with the end 352 disposed in the pocket 376, while the other bushing 356 does not have a pocket 376 and is configured similar to the bushing 156 depicted in FIGS. 2, 3, 5, and 6. The bushing(s) 356 including the pocket 376 reduce chatter as the shaft 344 rotates relative to the wall 340 of the auxiliary region 338 of the exhaust valve assembly 300. The bushing(s) 356 including the pocket 376 also prevent the vane 346 from moving from side to side within the housing 322.

Figure 12:
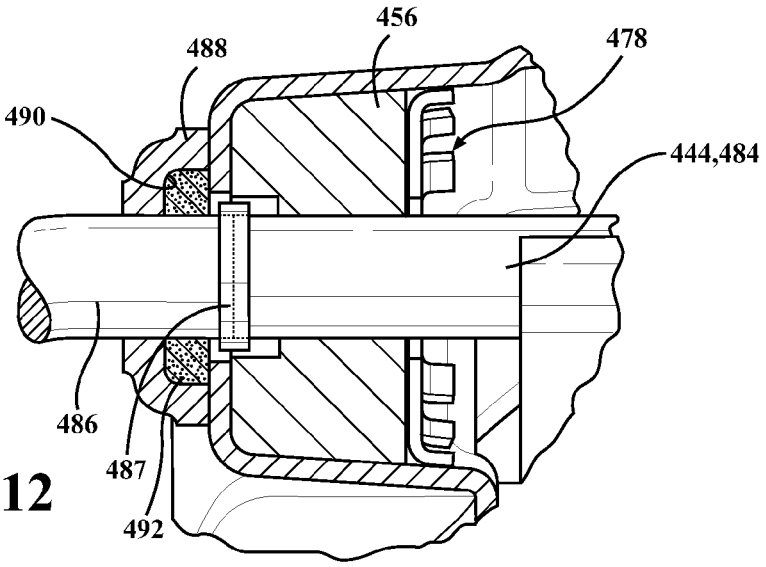
FIG. 12 is an enlarged segment of the portion of the exhaust valve assembly of FIG. 11.
Figure 13:
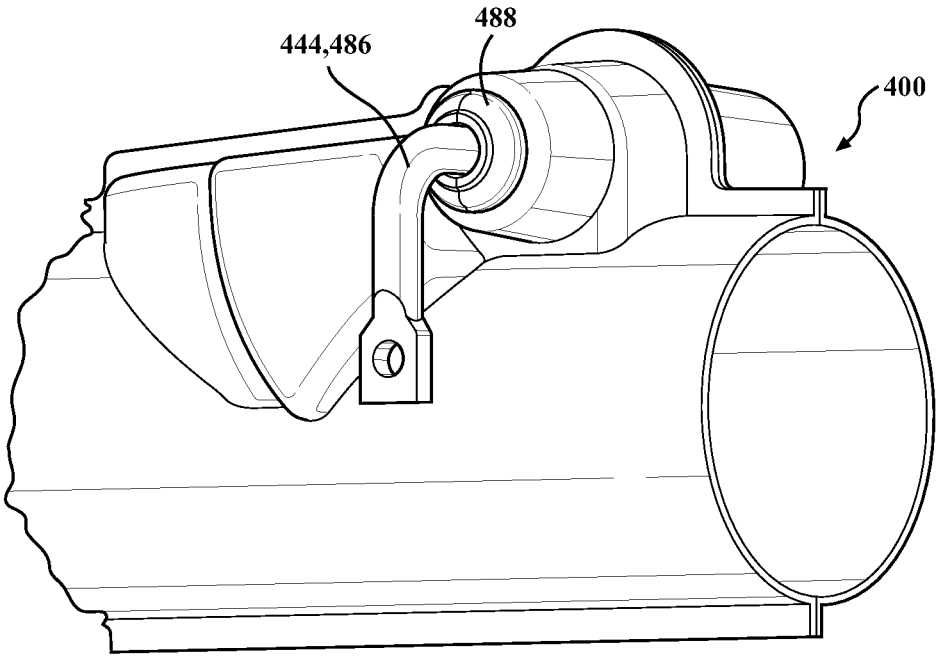
FIG. 13 is a perspective view of the exhaust valve assembly of FIG. 11 depicting the cap disposed around the second portion of the shaft.
Figure 14:
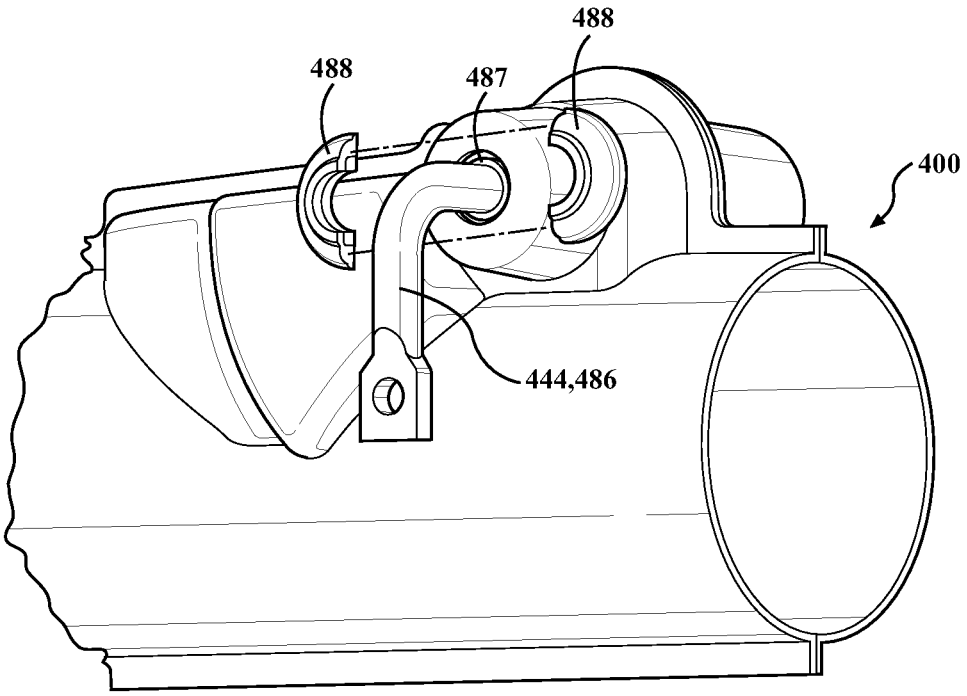
FIG. 14 is a perspective view of the exhaust valve assembly of FIG. 11 depicting an exploded view of the cap.

Referring now to FIGS. 11 through 14, another example of the exhaust valve assembly 400 includes all of the features of the exhaust valve assembly 300 shown in FIG. 10. However, the shaft 444 of the vane assembly 448 has a first portion 484 disposed in the auxiliary region 438 and a second portion 486 disposed outside the space 442 of the auxiliary region 438. The first 484 and second 486 portions are connected to one another by a suitable pipe fitting or connector 487. The exhaust valve assembly 400 further includes a cap 488 disposed around the second portion 486 (as shown in FIGS. 13 and 14). In an example, the cap 488 is disposed around the second portion 486 by joining pieces of the cap 488 around the portion 486 of the shaft 444 (such as shown in FIG. 14). As shown in FIG. 12, the cap 488 includes a cavity 490 and a mesh pad 492 disposed in the cavity. It is believed that the cap 490 and mesh pad 492 seal the opening of the auxiliary region 438 through which the two portions 484, 486 of the shaft 444 are connected (i.e., to prevent leaking of exhaust gases outside of the housing 422), reduces chatter of the shaft 444 as the shaft 444 rotates, and also prevents detachment of the second portion 486 from the first portion 484 and thus from the exhaust valve assembly 400.

Figure 19:
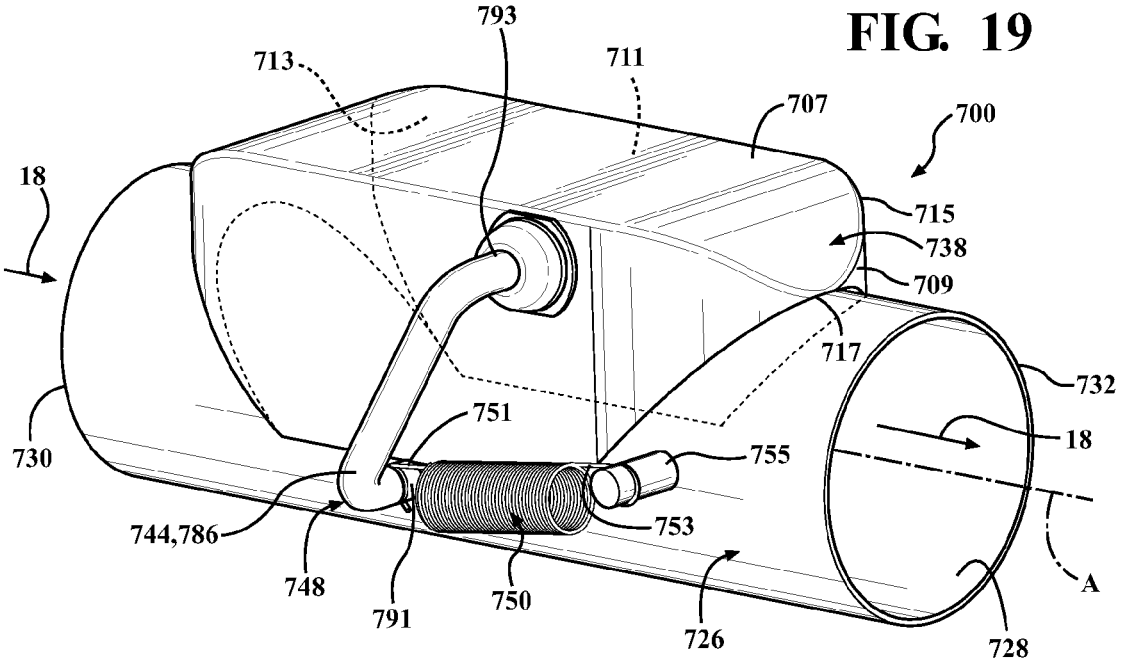
FIG. 19 is a perspective view of another example of the exhaust valve assembly including an auxiliary region coupled to the body region, where the exhaust valve assembly includes a vane assembly having a resilient member disposed on a portion of the shaft outside the auxiliary region.

In an example, the other portion 486 of the shaft 444 is designed to be coupled to a control device (not shown), such as an actuator, at an end 489 thereof. In another example, the other portion 486 is designed to be coupled to a resilient member (also not shown). In this example, the resilient member 450 (which is disposed on the shaft 444) is removed from the vane assembly 448, and movement of the vane 446 is controlled by the resilient member coupled to the portion 486 of the shaft 444. An example of the configuration of the resilient member coupled to the portion 486 of the shaft 444 is shown in FIG. 19, which will be described in further detail below.

The example of the exhaust valve assembly 400 also includes a nut 478 disposed about each of the ends (not shown in FIGS. 13 and 14) of the shaft 444 adjacent to the bushings 456. Further details of the nut 478 are described below in conjunction with FIG. 15.

Figure 15:
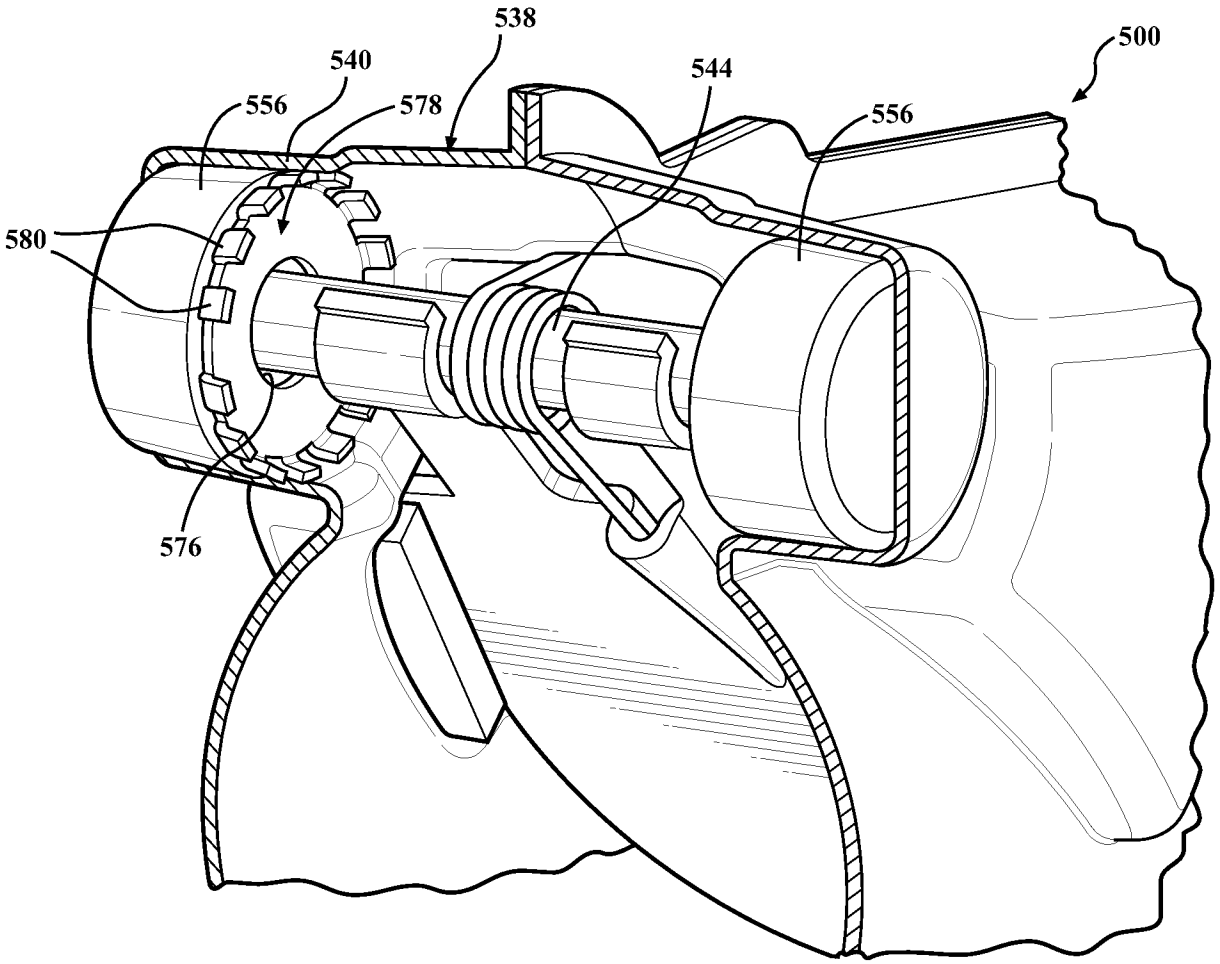
FIG. 15 is a perspective view of a portion of yet another example of the exhaust valve assembly including a nut disposed about each end of the shaft adjacent to the bushing.

As shown in FIG. 15, still another example of the exhaust valve assembly 500 includes all of the features of the exhaust valve assembly 300, as well as a nut 578 disposed about each of the ends of the shaft 544 adjacent to the bushings 556. The nut 578 includes a plurality of teeth 580 configured to grip the wall 540 of the auxiliary region 538. The nut 578 is configured to prevent the bushing 556 from sliding inwardly relative to the wall 540. When the exhaust valve assembly 500 is manufactured, the nut 578 is pressed into each of the recesses 560, 562 defined in the wall 540 of the auxiliary region 538. Upon doing so, the teeth 580 extend outwardly and grip the wall 540 of the auxiliary region 538, thereby retaining the bushing 556 in the recess 560, 562.

Figure 16:
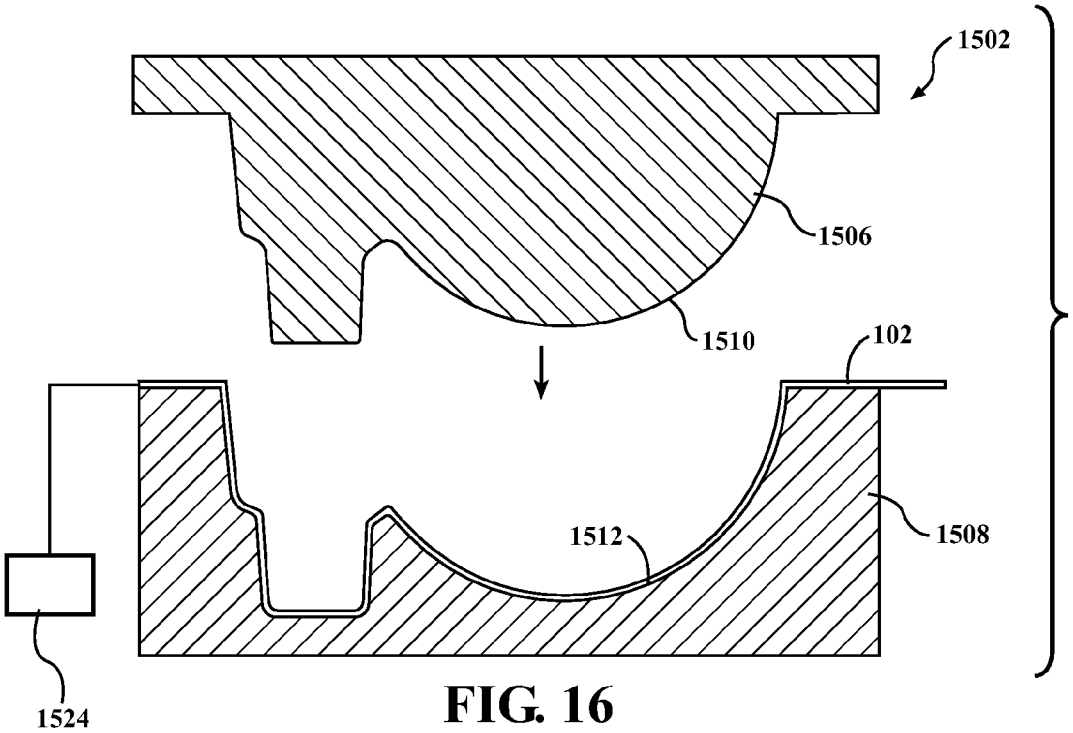
FIG. 16 schematically illustrates post stamping of the first piece of the exhaust valve assembly of FIG. 2 utilizing a stamping press.
Figure 17:
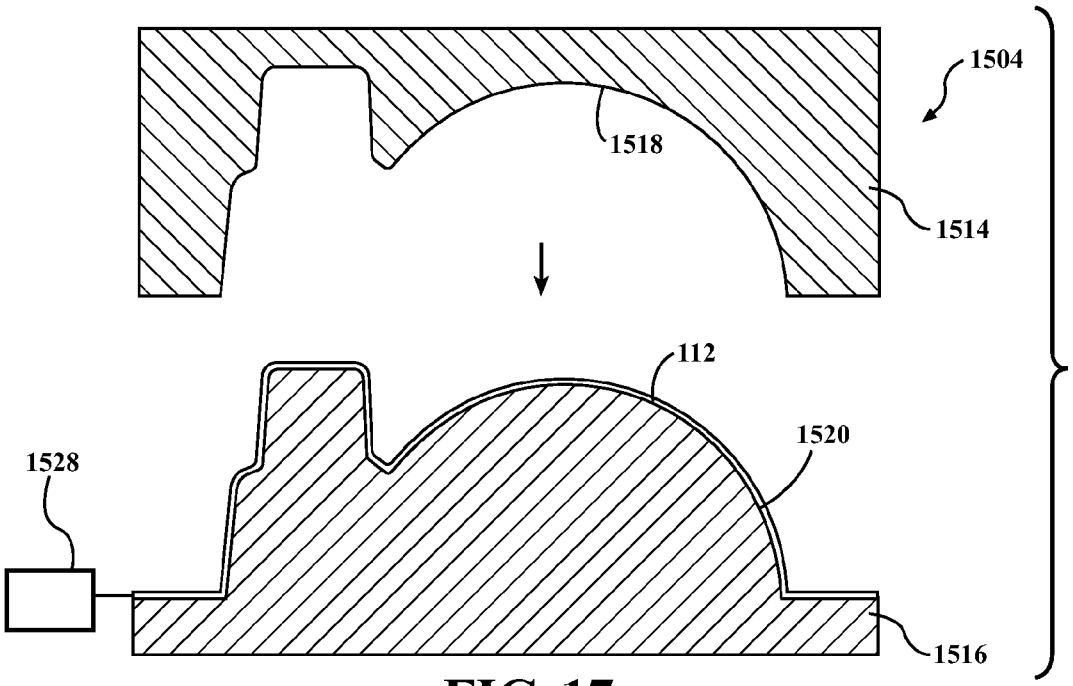
FIG. 17 schematically illustrates post stamping of a second piece of the exhaust valve assembly of FIG. 2 utilizing another stamping press.

The examples of the exhaust valve assembly 100, 200, 300, 400, 500 described above may be manufactured according to a method that is described below in conjunction with FIGS. 16 and 17. The method involves forming the first piece 102, 202 and forming the second piece 112, 212. In instances where the first 102 and second 112 pieces are formed separately (such as for the exhaust valve assembly 100 described in conjunction with FIG. 2 through 7), the first piece 102 is formed in a first stamping press 1502 (as shown in FIG. 16) and the second piece 112 is formed in a second stamping press 1504 (as shown in FIG. 17). The stamping press 1502 includes an upper 1506 and lower 1508 die each having a surface 1510, 1512 conforming to the configuration and geometry of the first piece 102. Similarly, the stamping press 1504 includes an upper 1514 and lower 1516 die each having a surface 1518, 1520 conforming to the configuration and geometry of the second piece 112. A sheet metal blank (which may be supported by a brace or other support structure 1524) is placed between the dies 1506, 1508, and another sheet metal blank (which may also be supported by a brace or other support structure 1528) is placed between the dies 1514, 1516. The first piece 102 is formed when the first die 1506 is drawn toward the second die 1508 in a single stamping operation, and the second piece 112 is formed when the first die 1514 is drawn toward the second die 1516 also in a single stamping operation.

Figure 18:
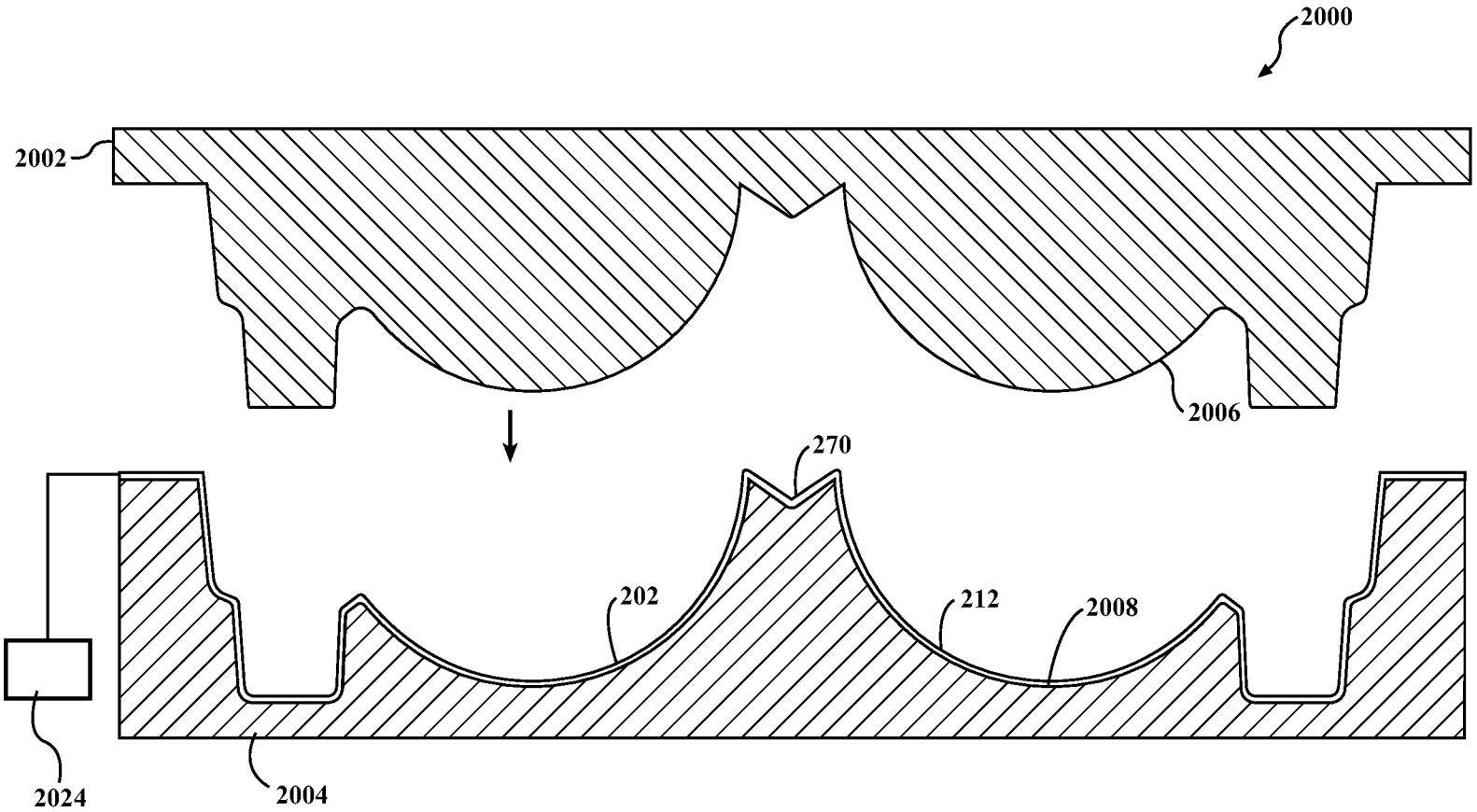
FIG. 18 schematically illustrates post stamping of a clamshell housing for the exhaust valve assembly of FIG. 8 utilizing yet another stamping press.

In instances where the first piece 202 and the second piece 212 are pre-joined (such as for the exhaust valve assembly 200 depicted in FIGS. 8 and 9), the first 202 and second 212 pieces are formed in a single stamping operation. As schematically shown in FIG. 18, where the stamping press 2000 includes a first die 2002 having a first forming surface 2006 and a second die 2004 having a second forming surface 2008. The forming surfaces 2006, 2008 are shaped to conform to the configuration and geometry of the first piece 202, the second piece 212, and the living hinge 270 between the first 202 and second 212 pieces. A sheet metal blank (which may be supported by a brace or other support structure 2024) is placed between the dies 2002, 2004, and the first 202 and second 212 pieces are formed together when the first die 2002 is drawn toward the second die 2004 in a single stamping operation.

It is to be understood that the first 102, 202 and second 112, 212 pieces may be formed using other suitable forming methods.

The example of the method of manufacturing the exhaust valve assembly 100, 200, 300, 400, 500 further includes forming the vane assembly 148, and then coupling a first portion of the vane assembly 148 to the first auxiliary region 106. The vane assembly 148 is generally formed by coupling the vane 146 to the shaft 144. Various examples of the method of coupling the vane 146 to the shaft 144 were previously described at least with reference to FIG. 4. In another example, the method of forming the vane assembly 148 further includes disposing the resilient member 150 on the shaft 144, and then coupling the vane 146 to the shaft 144. The resilient member 150 may be disposed on the shaft 144 by sliding the coil 164 of the resilient member 150 onto the shaft 144, and positioning one of the legs 166 within the pocket 168 defined in the vane 146 as the vane 146 is being coupled to the shaft 144.

The vane assembly 148 is coupled to the auxiliary region 138 by inserting a first segment of the shaft 144 (i.e., the end 152) into the recess 160 defined in the first auxiliary region 106. In an example, a bushing (such as the bushing 156 shown in FIG. 2) is inserted into the recess 160 prior to inserting the first segment of the shaft 144. The other segment of the shaft 144 (i.e., the end 154) is inserted into the recess 162 defined in the first auxiliary region 106 when the first 102, 202 and second 112, 212 pieces are joined to one another. In an example, another bushing (such as the bushing 156) is inserted into the other recess 162 prior to inserting the other segment of the shaft 144.

With reference again to FIG. 15, in another example, the nut 578 is inserted into the recess 560, then the bushing 556 is inserted into the recess 160, and then the first segment of the shaft 544 is inserted into the pocket 576 of the bushing 556. As previously mentioned, the nut 578 grabs the wall 540 of the auxiliary region 538 and prevent the bushing 556 from sliding inwardly relative to the wall 540. Thereafter, another nut 578 may be inserted into the other recess 162, then another bushing 556 is inserted into the other recess 562, and then the second segment of the shaft 544 is inserted into the pocket (not shown in FIG. 15) of the other bushing 556.

For the exhaust valve assembly 100, the first 102 and second 112 pieces are joined to one another by bonding the edges 108, 118 of the first 104 and second 114 body regions together and bonding the edges 110, 120 of the first 106 and second 116 auxiliary regions together. Bonding of the edges 110, 120 may be accomplished metallurgically, mechanically, or combinations thereof. For the exhaust valve assembly 200, the first 202 and second 212 pieces are joined to one another by bending the living hinge 270 until the edges 210, 220 contact one another, and then bonding the edges 210, 220 together. Bonding of the edges 210, 220 may be accomplished metallurgically and/or mechanically.

Examples of the exhaust valve assembly 700, 800, 900, 1000, 1100 having a body region and an auxiliary region that are formed as separate pieces and then are coupled or connected to one another will now be described herein in conjunction with FIGS. 19 through 26.

Referring now to FIG. 19, the exhaust valve assembly 700 includes the body region 726 which is elongated and hollowed, and may be formed of any material, such as a metal. The body region 726 is shown in FIG. 19 as having a substantially circular cross-section; however, the body region 726 may have other cross-sections, such as a rectangular cross-section, and the like. The body region 726 has a surface 728 defining an inlet end 730 and an outlet end 732. The inlet end 730 is spaced apart from and disposed opposite the outlet end 732. The flow 18 of engine exhaust passes through the body region 726 typically from the inlet end 730 to the outlet end 732 along an axis A. Furthermore, at least one of the inlet end 730 and the outlet end 732 of the body region 726 is coupled to at least one pipe 16 of the exhaust system 12 (as shown in FIG. 1).

A length of the body region 726 is defined between the inlet end 730 and the outlet end 732 of the body region 726 along the axis A. The body region 726 may also have any suitable diameter and may be coupled to any size pipe 16 of the exhaust system 12. An opening (not shown in FIG. 19) is defined by the surface 728 of the body region 726 between the inlet end 730 and the outlet end 732. The opening may have any suitable configuration, as previously described.

The exhaust valve assembly 700 further includes the auxiliary region 738 that is coupled to the body region 726 over the opening to close the opening. The auxiliary region 738, which may be defined as a cap, may be connected to the body region 726 or integrally formed with the body region 726. As mentioned above, the auxiliary region 738 houses various components of the exhaust valve assembly 700, such as the all or part of a vane assembly 748.

The auxiliary region 738 includes at least one wall. In one example, the auxiliary region 738 includes a first wall 707 and a second wall 709. The first wall 707 may have any suitable configuration without departing from the scope of the present disclosure. For example, the first wall 707 may have a substantially planar configuration. Alternatively, the first wall 707 may have any suitable non-planar configuration, such as a curved configuration, and the like. Furthermore, the first wall 707 has an outer surface 711 and an inner surface 713 opposite the outer surface 711. The inner surface 713 typically faces the opening defined by the surface 728 of the body region 726. The first wall 707 has a surface area defining any suitable shape, including, but not limited to, a rectangle, an oval, a semi-circle, and the like.

The first wall 707 is coupled to and supported by the second wall 709. The second wall 709 includes a first edge 715 and a second edge 717 opposite the first edge 715. The first edge 715 of the second wall 709 is coupled to the inner surface 713 of the first wall 707. The first edge 715 of the second wall 709 may be fastened to or integrally formed with the inner surface 713 of the first wall 707. The second edge 717 of the second wall 709 is coupled to the surface 728 of the body region 704. The second edge 717 of the second wall 709 may be fastened to or integrally formed with the surface 728 of the body region 726. The second edge 717 preferably surrounds the opening such that the auxiliary region 738 encloses the opening. It is to be appreciated that the first wall 707 and the second wall 709 of the auxiliary region 738 may be divided into any suitable number of walls. Accordingly, the first wall 707 and the second wall 709 are disposed entirely outside of the surface 728 of the body region 726. As such, the auxiliary region 738 is substantially outside of the flow 18 of exhaust gas. In this way, the flow 18 of exhaust gas is substantially unaltered by the auxiliary region 738. The first and second walls 707, 709 of the auxiliary region 706 may also include at least one perforation for tuning purposes.

The auxiliary region 738 may further allows access to various components of the exhaust valve assembly 700 for installation and maintenance purposes. In one example, the first and second walls 707, 709 may be detached from the body region 726 for allowing access within the body region 726 and the auxiliary region 738. In another example, the first wall 707 may detach from the second wall 709 for allowing access to within the auxiliary region 738. Alternatively, the first wall 707 may include a hinge for allowing the first wall 707 to open for allowing access to within the auxiliary region 738. It is to be appreciated that the second wall 709 may also detach from the first wall 707 or include a hinge for allowing access to within the auxiliary region 738.

Also with reference to FIG. 19, the vane assembly 748 includes the vane (not shown) and the shaft 744, a portion 786 of which is exterior to the body region 726 and the auxiliary region 738. The vane assembly 748 further includes the resilient member 750, which is shown in FIG. 19 as a spring, and which is disposed exterior to the body region 726. In this example, the portion 786 of the shaft 744 is pivotally coupled to another portion (not shown) of the shaft 744 that is disposed inside the auxiliary region 738 of the exhaust valve assembly 700. The portion 786 pivots in response to movement of the other portion of the shaft 744 disposed inside the auxiliary region 738. More specifically, the portion 786 pivots according to movement of the vane in response to forces exerted on the vane from the flow 18 of exhaust gas.

The portion 786 has a first end 791 and a second end 793. The first end 791 is coupled to a first end 751 of the resilient member 750. The second end 793 of the portion 786 is coupled to the other portion of the shaft 744 that is disposed inside the auxiliary region 738. In an example, the portion 791 of the shaft 744 may be integrally formed with the other portion of the shaft 744 that is disposed inside the auxiliary region 738. Alternatively, the portion 786 may be separate and detachable from the other portion of the shaft 744.

A fastener 755 may be coupled to the body region 726, and a second end 753 of the resilient member 750 is coupled to the fastener 755. The second end 753 of the resilient member 750 may otherwise be directly coupled to the body region 726. In any event, the resilient member 750 is separated from the shaft 744. Furthermore, the resilient member 750 may be disposed substantially parallel to the axis A.

In the example shown in FIG. 19, the resilient member 750 is a spring that may be compression biased such that the first end 751 is biased towards the second end 753 of the resilient member 750. However, the resilient member 750 may be extension biased such that the first end 751 of the spring is biased away from the second end 753. The spring biases the vane against the flow 18 of exhaust gas, and towards the closed position. Hence, the exhaust valve assembly 700 is "normally closed" and forces exerted on the vane from the flow 18 of exhaust gas intermittently force the vane towards the open position. However, the spring may bias the vane in either the clockwise or the counterclockwise direction depending upon the position of the portion 786 of the shaft 744 with respect to the other portion of the shaft 744 that is disposed inside the auxiliary region 738.

Figure 20:
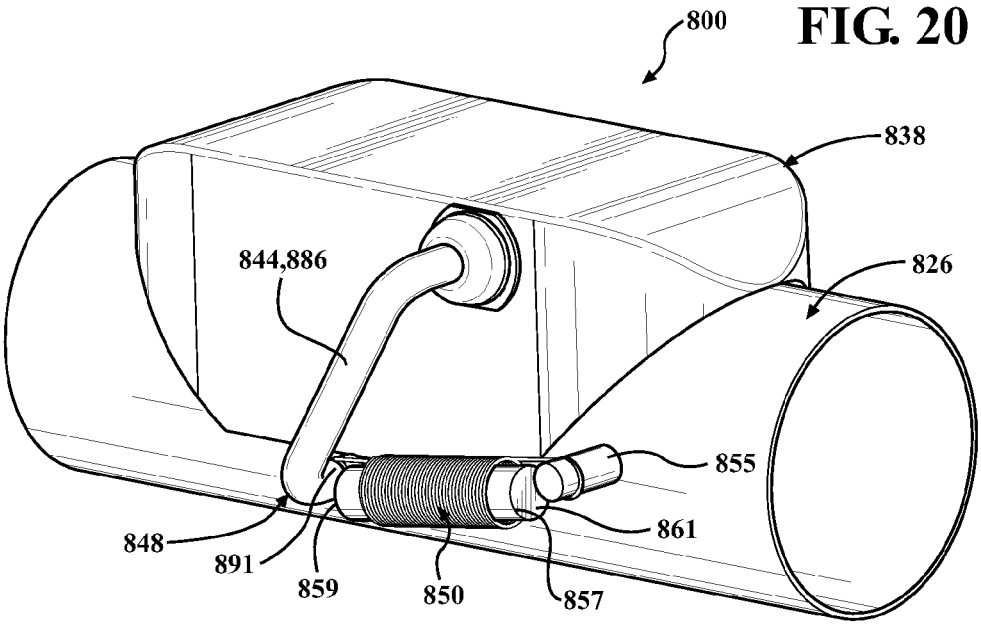
FIG. 20 is a perspective view of another example of the exhaust valve assembly including an auxiliary region coupled to the body region, where the exhaust valve assembly includes a vane assembly having a resilient member disposed on a portion of the shaft outside the auxiliary region and a stop member coupled to the shaft adjacent to the resilient member.
Figure 21:
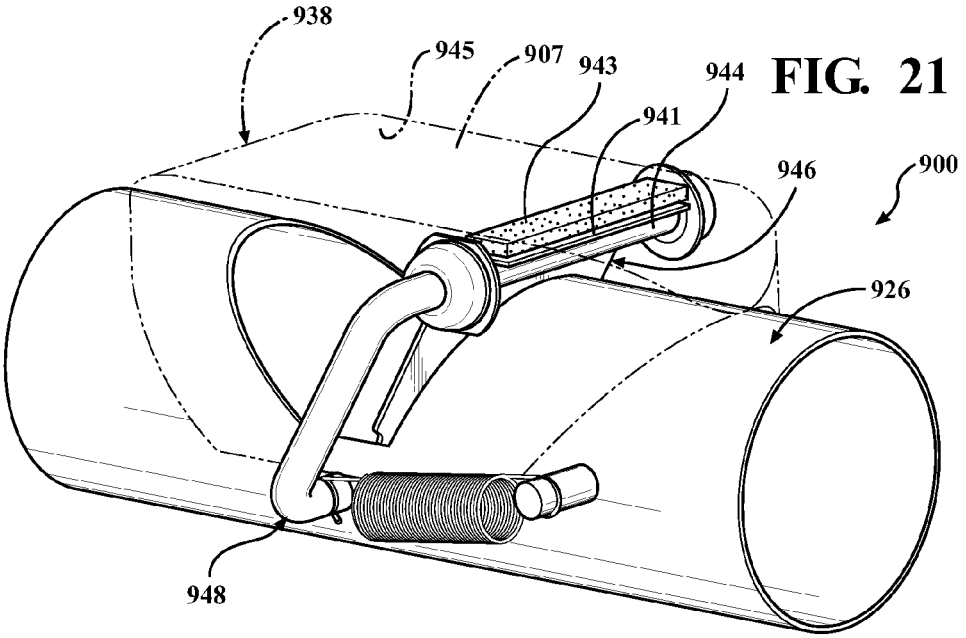
FIG. 21 is a perspective view of yet another example of the exhaust valve assembly partially in phantom, where a stop pad is disposed on a portion of the shaft between the vane and the inner surface of the auxiliary region.

The exhaust valve assembly 800 depicted in FIG. 20 includes all of the same features as the exhaust valve assembly 700 depicted in FIG. 19. However, the exhaust valve assembly 800 further includes a stop member 857 is disposed adjacent to the resilient member 850 for absorbing impact from between the vane (not shown) and the body region 826. The stop member 857 may be disposed within the resilient member 850 such that the stop member 857 is supported by the resilient member 850. However, it is to be appreciated that the stop member 857 may be supported by the resilient member 850 and/or the body region 826 according to any other suitable configuration.

The stop member 857 includes a first stop end 859 and a second stop end 861. The first stop end 859 is disposed adjacent to the end 891 of the portion 886 of the shaft 844, and the second stop end 861 is disposed adjacent the fastener 855.

The stop member 857 is usable in instances where the resilient member 850 forcibly pulls the vane towards the closed position in response to sudden changes in the flow 18 of exhaust gas. In such instances, the vane may forcibly abut the body region 826 and generate undesirable acoustic noise. The stop member 857 prevents the vane from abutting the body region 826. As mentioned above, the portion 886 of the shaft 844 moves towards the closed position in response to the vane. As the vane enters the closed position, the end 891 moves towards the first stop end 859. Simultaneously, the second end 861 of the stop member 857 moves towards the fastener 855. This is due, at least in part, to the first end 891 forcing the second stop end 861 to move towards the fastener 855. Eventually, the first end 891 abuts the first stop end 859 while the second stop end 861 abuts the fastener 855. As such, the stop member 857 provides a counter-acting force against movement of the portion 886 of the shaft 844, and effectively the vane, towards the closed position.

The stop member 857 also defines a predetermined length between the first stop end 859 and the second stop end 861. The predetermined length of the stop member 857 is configured such that the stop member 857 prevents the shaft portion 886 from advancing beyond a predetermined position. In the predetermined position, the vane may be in the closed position; however, the outer edge of the vane does not directly abut the body region 826.

As the vane moves towards the open position, the first stop end 859 spaces from the first end 891 of the portion 886 of the shaft 844 and the second stop end 861 spaces from the fastener 855. In the example shown in FIG. 20, the stop member 857 remains supported within the spring 850 and may move along with the spring 850 in response to movement of the portion 886 of the shaft 844 and the vane.

It is to be understood that the stop member 857 is outside of the flow 18 of exhaust gas, and therefore the flow 18 of exhaust gas is unaltered by the stop member 857. Additionally, the stop member 857 may include any suitable material for absorbing impact. For example, the stop member 857 may be flexible or solid, and may be made of or include metal, plastic, silicone, or any other suitable material. Yet further, the stop member 857 may have any suitable configuration. As shown in FIG. 20, the stop member 857 has a cylindrical or rod-like configuration. It is to be understood, however, that the stop member 857 may have any other suitable configuration without departing from the scope of the present disclosure.

Referring now to FIGS. 21 through 24, another example of the exhaust valve assembly 900 is shown and includes all of the features of the exhaust valve assembly 800. In this example, the exhaust valve assembly 900 includes the vane assembly 948 which includes the vane 946 having a ledge 941. The ledge 941 extends integrally from the vane 946 and rotates with the vane 946 as the vane 946 moves between the open position (as shown in FIGS. 23 and 24) and the closed position (FIG. 22). In another example (which is not shown), the shaft 944 includes the ledge 941 such that the ledge 941 extends radially from the shaft 944. In this example, the ledge 941 is fixed to the shaft 944 and rotates with the shaft 944 as the vane 946 moves between the open and closed positions. Further, the ledge 941 is disposed generally on an opposing side of the shaft 944 compared with the vane 944.

The stop pad 943 is disposed directly on the ledge 941 for preventing impact from the vane 946 on the body region 926 as the vane 946 moves to the closed position (as shown in FIG. 22). In this example, the ledge 941 and the stop pad 943 simultaneously rotate towards an inner surface 945 of the wall 907 of the auxiliary region 938. Eventually, the stop pad 943 abuts the inner surface 945 just before the vane 946 fully enters the closed position. In doing so, the stop pad 943 stops the shaft 944 and the vane 946 from further rotating just before the vane 946 impacts the body region 926.

The ledge 941 may be spaced from the vane 946 according to any predetermined angle necessary to position the stop pad 943 for effectively preventing the vane 946 from impacting the body region 926. Furthermore, the stop pad 943 may have any suitable thickness.

It is to be understood that the exhaust valve assembly 900 may include a plurality of stop pads 943 disposed in/at various locations on the shaft 944 or on the vane 946.

Referring again to FIG. 24, the vane 946 is shown in the open position, where virtually no portion of the vane 946 intersects the flow path of exhaust gas inside the body region 926. When the vane 946 is in the open position, the vane 946 is completely housed inside the auxiliary region 938, and the flow 18 of the exhaust gas remains unobstructed by the vane 946. It is to be understood that FIG. 24 is relevant to all of FIGS. 19-23, 25, and 26.

In another example, the exhaust valve assembly 1000 shown in FIG. 25 is the same as the exhaust valve assembly 900 shown in FIGS. 21 through 24 except that the ledge 1041 is adapted to engage the stop pad 1043 that is fixed to the inner surface 1045 of the wall 1007 of the auxiliary region 1038. The ledge 1041, which is formed on the vane 1046, engages the stop pad 1043 as the vane 1046 moves from the open position to the closed position. For instance, the ledge 1041 rotates independent of the stop pad 1043 as the vane 1046 approaches the closed position. Eventually, the ledge 1041 abuts the stop pad 1043 just before the vane 1046 fully enters the closed position to prevent impact between the vane 1046 and the body region 1026.

Figure 26:
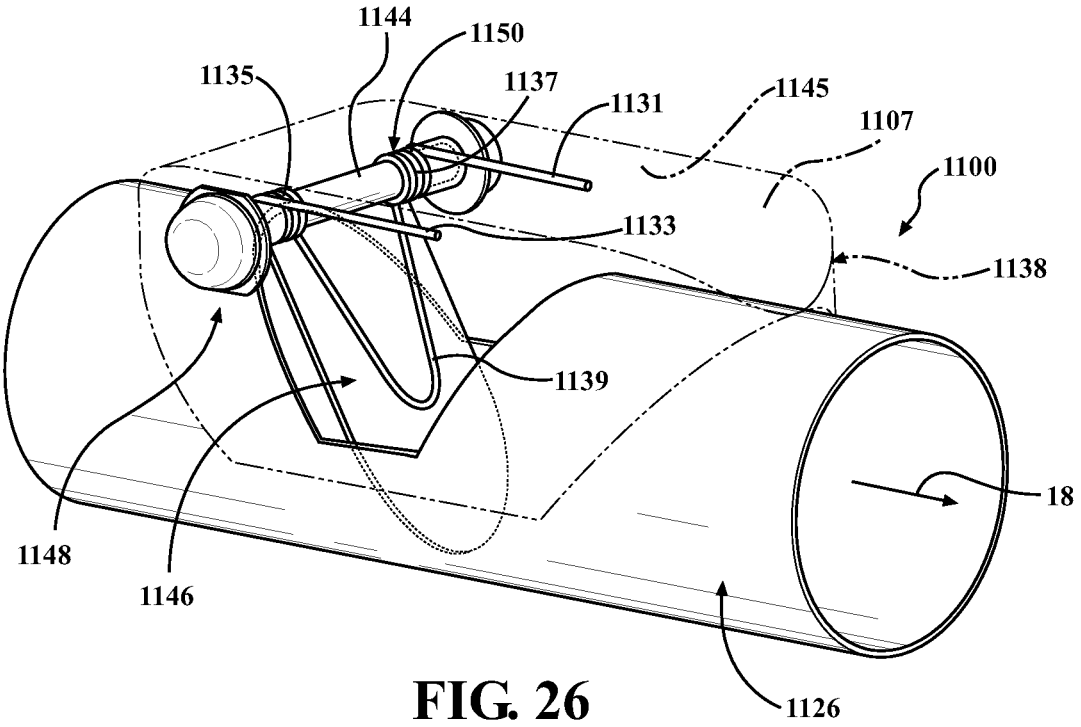
FIG. 26 is a perspective view of another example of the exhaust valve assembly showing the body region and the auxiliary region, partially in phantom, coupled to the body region, and a resilient member disposed on the shaft, where the resilient member includes two coils and an arm that biases the vane to the closed position.

Yet another example of the exhaust valve assembly 1100 is shown in FIG. 26. In this example, the resilient member 1150 is disposed inside the auxiliary region 1138. The resilient member 1150 is a spring disposed on and supported by the shaft 1144. The spring in this example is torsionally biased, and biases the vane 1146 in a clockwise direction against the flow 18 of exhaust gas and towards the closed position.

The resilient member 1150 may have a plurality of coils with an arm disposed between adjacent coils. For instance, in the example depicted in FIG. 26, the resilient member 1150 includes first 1131 and second 1133 ends each extending from a first 1135 and second 1137 coils, respectively, in a linear configuration. The first 1131 and second 1133 ends abut the inner surface 1145 of the wall 1107 of the auxiliary region 1138. The inner surface 1145 generally provides counter-acting force against the torsional force exhibited by each of the first 1131 and second 1133 ends of the resilient member 1150. It is to be appreciated that the first 1131 and second 1133 ends may alternatively be coupled to the inner surface 1145 of the wall 1107.

The resilient member 1150 further includes an arm 1139 disposed between the first 1135 and second 1137 coils. The arm 1139 extends away from the coils 1135, 1137 and abuts the vane 1146 for providing a counter-acting force against movement of the vane 1146 towards the open position. It is to be appreciated that the arm 1139 may otherwise be coupled to the vane 1146.

It is to be understood that the resilient member 1150 may otherwise have more than two coils with an arm disposed between adjacent coils. For instance, the resilient member 1150 may have three coils having an arm disposed between the first and second coils and another arm disposed between the second and third coils.

Also disclosed herein is a method of manufacturing the exhaust valve assembly 700, 800, 900, 1000, 1100. The method involves forming the body region 726, 826, 926, 1026, 1126 and forming an auxiliary region 738, 838, 938, 1038, 1138. The body region 726, 826, 926, 1026, 1126 and the auxiliary region 738, 838, 938, 1038, 1138 may be formed, for example, using a stamping process, similar to the stamping processes described above for forming the first 102, 202 and second 112, 212 pieces of the exhaust valve assembly 100, 200, 300, 400, 500.

An opening (such as the opening 936 shown in FIG. 22) is formed in the body region 726, 826, 926, 1026, 1126. As mentioned above, the opening 936 may have any desirable geometry or shape, including a circular shape, a square shape, a rectangular shape, etc. The opening 936 may be formed using any suitable machining or cutting process.

Formation of the vane assembly 748, 848, 948, 1048 will now be described utilizing the example of the exhaust valve assembly 700 shown in FIG. 19. The vane assembly 748 is formed by coupling the vane (not shown) to a portion (not shown) of the shaft 744 disposed inside the auxiliary region 738, such as previously described with reference to FIG. 4. Then, the resilient member 750 is disposed on the portion 786 of the shaft 744 that is exterior to the auxiliary region 738. The resilient member 750 may be disposed on the portion 786 of the shaft 744 by coupling the end 751 of the resilient member 750 to the end 791 of the portion 786 and coupling the other end 753 of the resilient member 750 to the fastener 755 that is coupled to the body region 726.

In an example, and with reference to the exhaust valve assembly 800 shown in FIG. 20, the stop member 857 may be coupled to the portion 886 of the shaft 844 adjacent the resilient member 850 (such as disposed inside the coil of the spring, as shown in FIG. 20) prior to coupling the resilient member 850 to the portion 886 of the shaft 844 and the fastener 855.

The vane assembly 748, 848, 948, 1048 is then coupled to the auxiliary region 738, 838, 938, 1038, and will be described with reference again to the exhaust valve assembly 700 shown in FIG. 19. The vane assembly 748 may be coupled to the auxiliary region 738, for example, by removing at least the wall 707 of the auxiliary region 738, and then inserting a first segment of a portion (not shown) of the shaft 744 disposed inside the auxiliary region 738 into an aperture defined in the auxiliary region 738. The other segment of the portion of the shaft 744 disposed inside the auxiliary region 738 is inserted into a receiving end formed on or otherwise coupled to the wall 707 of the auxiliary region 738. The wall 707 (and other walls if any were also removed) is replaced. Thereafter, the other portion 786 of the shaft 744 is coupled to the portion of the shaft 744 disposed inside the auxiliary region 738.

The vane assembly 1148, on the other hand, may be assembled using any of the methods previously described for forming the vane assembly 148 shown in FIG. 4, and the vane assembly 1148 may be coupled to the auxiliary region 1138 by the method as previously described for coupling the vane assembly 148 to the auxiliary region 138.

Once the vane assembly 748, 848, 948, 1048, 1148 is coupled to the auxiliary region 738, 838, 938, 1038, 1138, the auxiliary region 738, 838, 938, 1038, 1138 is coupled to the body region 726, 826, 926, 1026, 1126 about the opening (such as the opening 936 shown in FIG. 22) of the body region 726, 826, 926, 1026, 1126 such that the auxiliary region 738, 838, 938, 1038, 1138 is in communication with the opening outside the flow path of the exhaust gas. In an example, the auxiliary region 738, 838, 938, 1038, 1138 is coupled to the body region 726, 826, 926, 1026, 1126 by bonding the auxiliary region 738, 838, 938, 1038, 1138 to the body region 726, 826, 926, 1026, 1126. Bonding may be accomplished mechanically (e.g., using a fastener such as a bolt, a screw, a clamp, etc.), metallurgically (e.g., welding, brazing, etc.), or combinations thereof.

It is to be understood that one or more of the examples described above in conjunction with FIGS. 1 through 15 may be incorporated or otherwise applied to any of the examples described above in conjunction with FIGS. 19 through 26, and visa versa. For instance, any of the examples described above in conjunction with FIGS. 1 through 15 may utilize a vane assembly having a resilient member positioned exterior to the exhaust valve assembly, as shown and described in conjunction with FIGS. 19 and 20. In another instance, any of the examples described in conjunction with FIGS. 19 through 26 may utilize any of the examples of the bushing disposed about the ends of the shaft of the vane assembly as shown and described in conjunction with FIGS. 2 and 9.

While the invention has been described with reference to the examples above, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all examples falling within the scope of the appended claims.

What is claimed is:

1. An exhaust valve assembly for use in an exhaust system for directing a flow of an exhaust gas generated by an engine, said assembly comprising:

a body region having a first end and a second end and defining a longitudinal axis between said ends with said body region having an interior surface terminating at said ends and defining an area with a flow path for the flow of the exhaust gas within said body region along said axis, and said body region defining an opening;

an auxiliary region coupled to said body region about said opening with said auxiliary region having at least one wall defining a space outside of said area of said body region and outside of said flow path such that the flow of the exhaust gas is unaltered by said wall, said space being in communication with said area through said opening;

a shaft coupled to said wall of said auxiliary region; and a vane coupled to said shaft and moveable between an open position with said vane disposed entirely within said auxiliary region such that the flow of the exhaust gas is unaltered by said vane and a closed position with at least a portion of said vane disposed in said body region intersecting said axis and intersecting said flow path such that the flow of the exhaust gas is obstructed by said vane.

2. The exhaust valve assembly as set forth in claim 1 wherein said shaft has opposing ends coupled to said wall and further including a bushing disposed about each end of said shaft to further couple said shaft to said wall and to permit relative rotation of said shaft to said wall.

3. The exhaust valve assembly as set forth in claim 2 wherein at least one of said bushings has a pocket with at least one of said ends of said shaft disposed in said pocket.

4. The exhaust valve assembly as set forth in claim 1 wherein said vane is fixedly mounted to said shaft for concurrent rotation with said shaft.

5. The exhaust valve assembly as set forth in claim 2 further comprising a nut disposed about each of said ends of said shaft adjacent said bushing with said nut including a plurality of teeth configured to grip said bushing.

6. The exhaust valve assembly as set forth in claim 1 further comprising a resilient member configured to continuously bias said vane toward said closed position.

7. The exhaust valve assembly as set forth in claim 6 wherein said shaft has opposing ends and wherein said resilient member is disposed about said shaft between said ends and at least partially disposed within said space of said auxiliary region.

8. The exhaust valve assembly as set forth in claim 7 wherein said resilient member includes a plurality of coils and an arm between adjacent coils.

9. The exhaust valve assembly as set forth in claim 6 wherein said shaft comprises a first portion disposed in said space of said auxiliary region and a second portion disposed outside said space of said auxiliary region and wherein said resilient member is coupled to said second portion of said shaft outside of said auxiliary region.

10. The exhaust valve assembly as set forth in claim 9 further comprising a stop member coupled to said second portion of said shaft adjacent said resilient member.

11. The exhaust valve assembly as set forth in claim 1 wherein a portion of said auxiliary region radially protrudes from said longitudinal axis to form a ledge and further including a pad coupled to said vane and configured to contact said ledge when said vane is in the closed position.

12. The exhaust valve assembly as set forth in claim 11 wherein said vane comprises an edge having a shape that that is complementary in configuration to a shape of said radially protruding portion of said auxiliary region.

13. The exhaust valve assembly as set forth in claim 1 wherein said shaft comprises a first portion disposed in said space of said auxiliary region and a second portion disposed outside of said space of said auxiliary region and further including a cap disposed around said second portion of said shaft and defining a cavity and a mesh pad disposed within said cavity.

14. The exhaust valve assembly as set forth in claim 1 wherein said body region includes a first body region and a second body region, and said auxiliary region includes a first auxiliary region and a second auxiliary region with said first auxiliary region coupled to said first body region to define a first piece and said second auxiliary region coupled to said second body region to define a second piece at least partially separable from said first piece, wherein said first and second pieces are joined to one another to form a housing comprising said body and auxiliary regions.

15. The exhaust valve assembly as set forth in claim 14 wherein said pieces are mirror images of each other.

16. The exhaust valve assembly as set forth in claim 14 wherein said pieces are joined to one another mechanically, metallurgically, or combinations thereof.

17. The exhaust valve assembly as defined in claim 14 wherein said pieces are partially pre-joined to one another through a living hinge.

18. The exhaust valve assembly as defined in claim 1 wherein said auxiliary region encapsulates said opening.

19. An exhaust valve assembly for use in an exhaust system for directing a flow of an exhaust gas generated by an engine, said assembly comprising:

a first piece having a first body region and a first auxiliary region coupled to said first body region with at least one of said first body and auxiliary regions defining first edges;

a second piece having a second body region and a second auxiliary region coupled to said second body region with at least one of said second body and auxiliary regions defining second edges;

said first and second pieces being joined to one another along said edges to form a housing comprising a body region and an auxiliary region with said body region defining a longitudinal axis and an area with a flow path extending along said axis for the flow of the exhaust gas within said area along said axis and said body region defining an opening, and said auxiliary region forming at least one wall defining a space outside of said area of said body region and outside of said flow path such that the flow of the exhaust gas is unaltered by said wall, with said space being in communication with said area through said opening;

a shaft coupled to said wall of said auxiliary region; and a vane coupled to said shaft and moveable between an open position with said vane disposed entirely within said auxiliary region such that the flow of the exhaust gas is unaltered by said vane and a closed position with at least a portion of said vane disposed in said area intersecting said axis and intersecting said flow path such that the flow of the exhaust gas is obstructed by said vane.

20. The exhaust valve assembly as set forth in claim 19 wherein said pieces are mirror images of each other.

21. The exhaust valve assembly as set forth in claim 19 wherein said pieces are joined to one another mechanically, metallurgically, or combinations thereof.

22. The exhaust valve assembly as defined in claim 19 wherein said pieces are partially pre-joined to one another through a living hinge.

23. The exhaust valve assembly as set forth in claim 19 wherein said first auxiliary region is integrally formed with said first body region and wherein said second auxiliary region is integrally formed with said second body region.

24. The exhaust valve assembly as set forth in claim 19 wherein said shaft has opposing ends coupled to said wall and further including a bushing disposed about each end of said shaft to further couple said shaft to said wall and permit relative rotation of said shaft to said wall.

25. The exhaust valve assembly as set forth in claim 24 wherein each of said bushings has a pocket with each of said ends of said shaft disposed in one of said pockets.

26. The exhaust valve assembly as set forth in claim 24 further comprising a nut disposed about each of said ends of said shaft adjacent said bushing with said nut including a plurality of teeth configured to grip said bushing.

27. The exhaust valve assembly as set forth in claim 19 wherein said vane is fixedly mounted to said shaft for concurrent rotation with said shaft.

28. The exhaust valve assembly as set forth in claim 19 further comprising a resilient member configured to continuously bias said vane toward said closed position.

29. The exhaust valve assembly as set forth in claim 28 wherein said shaft has opposing ends and wherein said resilient member is disposed about said shaft between said ends and at least partially disposed within said space of said auxiliary region.

30. The exhaust valve assembly as set forth in claim 19 wherein said shaft comprises a first portion disposed in said space of said auxiliary region and a second portion disposed outside of said space of said auxiliary region and further including a cap disposed around said second portion of said shaft and defining a cavity and a mesh pad disposed within said cavity.

31. A method of manufacturing an exhaust valve assembly for use in an exhaust system for directing a flow of an exhaust gas generated by an engine, said method comprising the steps of:

forming a first piece having a first body region and a first auxiliary region coupled to said first body region with at least one of said first body and auxiliary regions defining first edges;

forming a second piece having a second body region and a second auxiliary region coupled to said second body region with at least one of said second body and auxiliary regions defining second edges;

coupling a first portion of a vane assembly to the first auxiliary region; and joining the first and second pieces together to form a housing comprising a body region and an auxiliary region with the body region defining a longitudinal axis and an area with a flow path extending along the axis for the flow of the exhaust gas within the area along the axis and the body region defining an opening, and the auxiliary region forming at least one wall defining a space outside of the area of the body region and outside of the flow path such that the flow of the exhaust gas is unaltered by the wall, with the space being in communication with the area through the opening.

32. The method as set forth in claim 31 further comprising the step of coupling a second portion of the vane assembly to the second auxiliary region as the first and second pieces are joined to one another.

33. The method as set forth in claim 31 wherein the steps of forming the first and second pieces are further defined as stamping the first and second pieces.

34. The method as set forth in claim 33 wherein the step of joining the first and second pieces is further defined as bonding the edges together.

35. The method as set forth in claim 31 wherein the vane assembly includes a vane and a resilient member each coupled to a shaft, and wherein the step of coupling the first portion of the vane assembly is further defined as coupling a first end of the shaft to the first auxiliary region.

36. The method as set forth in claim 35 further including the step of disposing the resilient member about the shaft between ends of the shaft prior to the step of coupling the first end of the shaft to the first auxiliary region.

37. The method as set forth in claim 35 wherein the step of coupling the first end of the shaft is further defined as inserting the first end of the shaft into a recess defined in the first auxiliary region.

38. The method as set forth in claim 37 further comprising the step of inserting a bushing into the recess prior to the step of inserting the first end of the shaft into the recess.

39. The method as set forth in claim 31 wherein the step of forming of the first and second pieces is further defined as simultaneously stamping the first and second pieces to form a clamshell housing having a living hinge pre-joining the first and second pieces to one another.

40. The method as set forth in claim 39 wherein the step of joining the first and second pieces is further defined as bending the living hinge until the edges contact one another and bonding the edges together.

* * * * *